US012692585B2

(12) United States Patent
Fujinaka et al.

(10) Patent No.: US 12,692,585 B2
(45) Date of Patent: Jul. 28, 2026

(54) HOT-STAMP FORMED BODY

(71) Applicant: NIPPON STEEL CORPORATION, Tokyo (JP)

(72) Inventors: Shingo Fujinaka, Tokyo (JP); Hitomi Nishibata, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 404 days.

(21) Appl. No.: 18/569,882

(22) PCT Filed: Sep. 20, 2022

(86) PCT No.: PCT/JP2022/034883

§ 371 (c)(1),
(2) Date: Dec. 13, 2023

(87) PCT Pub. No.: WO2023/074189

PCT Pub. Date: May 4, 2023

(65) Prior Publication Data

US 2024/0133007 A1 Apr. 25, 2024
US 2024/0229204 A9 Jul. 11, 2024

(30) Foreign Application Priority Data

Oct. 27, 2021 (JP) ..... 2021-175240

(51) Int. Cl.
*C22C 38/60* (2006.01)
*C21D 1/18* (2006.01)
(Continued)

(52) U.S. Cl.
CPC ..... *C22C 38/60* (2013.01); *C21D 1/18* (2013.01); *C21D 6/002* (2013.01); *C21D 6/004* (2013.01);
(Continued)

(58) Field of Classification Search
None
See application file for complete search history.

(56) References Cited

U.S. PATENT DOCUMENTS

2019/0330711 A1 10/2019 Abukawa et al.
2021/0381085 A1 12/2021 Hirashima et al.
(Continued)

FOREIGN PATENT DOCUMENTS

CA 3050217 A1 * 7/2018 ..... C22C 38/58
EP 2 105 515 A2 9/2009
(Continued)

OTHER PUBLICATIONS

Nowell et al. "Differentiating Ferrite and Martensite in Steel Microstructures Using Electron Backscatter Diffraction" Proceedings of the Materials Science and Technology Conference and Exhibition. Oct. 2009. (Year: 2009).*

*Primary Examiner* — Alexandra M Moore
(74) *Attorney, Agent, or Firm* — Birch, Stewart, Kolasch & Birch, LLP

(57) ABSTRACT

A hot-stamp formed body has a predetermined chemical composition and has a microstructure including, by area ratio, martensite: 90% to 100% and a remainder in the microstructure: 0% to 10%. The percentage of martensite having a GAIQ value of 40000 or less in all of the martensite is less than 5.0%, an average grain size of prior austenite grains is 6.0 μm or less, and a standard deviation of grain sizes of the prior austenite grains is 2.6 μm or less.

4 Claims, 1 Drawing Sheet

(51) Int. Cl.

| | |
|---|---|
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/38*** | (2006.01) |
| ***C22C 38/48*** | (2006.01) |
| ***C22C 38/50*** | (2006.01) |
| ***C22C 38/54*** | (2006.01) |

(52) U.S. Cl.

CPC ..... *C21D 6/005* (2013.01); *C21D 6/007* (2013.01); *C21D 6/008* (2013.01); *C21D 8/02* (2013.01); *C21D 8/0226* (2013.01); *C21D 8/0236* (2013.01); *C21D 8/0263* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/38* (2013.01); *C22C 38/48* (2013.01); *C22C 38/50* (2013.01); *C22C 38/54* (2013.01); *C21D 2211/001* (2013.01); *C21D 2211/008* (2013.01)

(56) References Cited

U.S. PATENT DOCUMENTS

| | | | |
|---|---|---|---|
| 2022/0119929 | A1 | 4/2022 | Fujinaka et al. |
| 2022/0127705 | A1 | 4/2022 | Fujinaka et al. |

FOREIGN PATENT DOCUMENTS

| | | | |
|---|---|---|---|
| JP | 2009-242832 | A | 10/2009 |
| WO | WO 2018/134874 | A1 | 7/2018 |
| WO | WO 2020/079925 | A1 | 4/2020 |
| WO | WO 2020/189761 | A | 9/2020 |
| WO | WO 2020/189767 | A1 | 9/2020 |

* cited by examiner

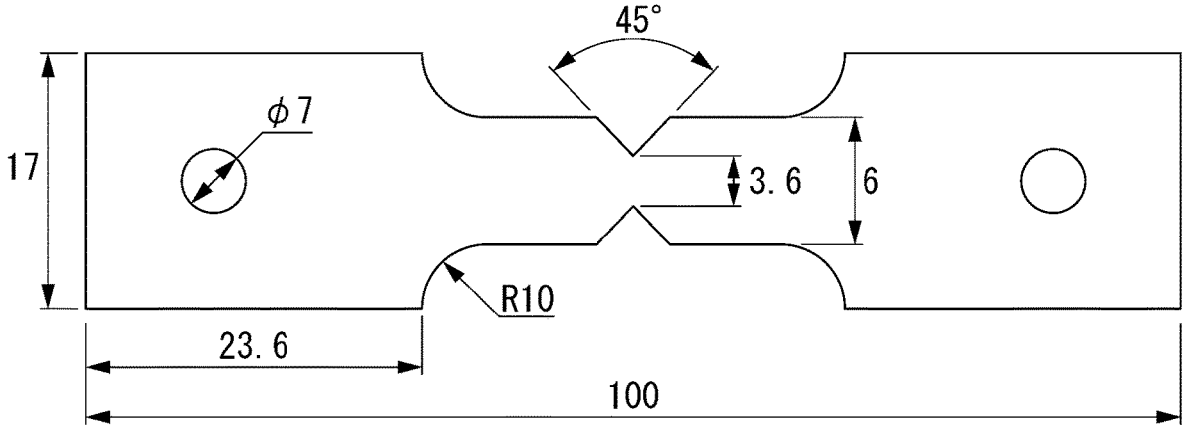
45°
ϕ7
17
3.6
6
R10
23.6
100

HOT-STAMP FORMED BODY

TECHNICAL FIELD OF THE INVENTION

The present invention relates to a hot-stamp formed body.

This application claims priority based on Japanese Patent Application No. 2021-175240 filed on Oct. 27, 2021, the content of which is incorporated herein by reference.

BACKGROUND ART

In recent years, there has been a demand for a reduction in the weight of a vehicle body of a vehicle in terms of environmental protection and resource saving, and a high strength steel sheet has been applied to vehicle members. Vehicle members are manufactured by press forming. With an increase in the strength of the steel sheet, a forming load is increased, and formability deteriorates. Therefore, the formability of the high strength steel sheet into a member having a complicated shape is an issue.

In order to solve this issue, the application of a hot stamping technique that performs press forming after a steel sheet is heated up to a high temperature of an austenite range where the steel sheet is softened is in progress. Hot stamping is attracting attention as technique that performs a hardening treatment in a die and punch at the same time as press working to achieve both the formability of a steel sheet into a vehicle member and the strength of the vehicle member.

For example, Patent Document 1 discloses an electrolytic zinc-based plated steel sheet which has high strength, a high yield ratio, and high bendability and in which the amount of diffusible hydrogen in steel is 0.20 mass ppm or less.

Patent Document 2 discloses a hot-stamp formed body having a steel structure represented by an area fraction of fresh martensite and tempered martensite: 80% or more in total, a prior austenite grain size: 20 μm or less, and an average grain size of carbide: 0.5 μm or less.

Patent Document 3 discloses a hot-stamp formed body in which an average grain size of prior austenite grains in a microstructure is 5.0 μm or less and an average Mn concentration at grain boundaries of the prior austenite grains is 1.0 mass % or less.

PRIOR ART DOCUMENT

[Patent Document]

[Patent Document 1] PCT International Publication No. WO2020/079925

[Patent Document 2] PCT International Publication No. WO2018/134874

[Patent Document 3] PCT International Publication No. WO2020/189767

DISCLOSURE OF THE INVENTION

Problems to be Solved by the Invention

In order to further reduce the weight of the vehicle body, it is effective to increase the strength of the steel sheet. Increasing the amount of martensite in a microstructure is considered as a method for increasing the strength of the steel sheet. However, when the amount of martensite is increased, the number of hydrogen trap sites is increased. Therefore, hydrogen is likely to infiltrate, and hydrogen embrittlement cracking is likely to occur in the hot-stamp formed body.

The hydrogen embrittlement cracking is a phenomenon in which a steel member, to which high stress is applied in use, suddenly fractures due to hydrogen infiltrating into the steel from an external environment. This phenomenon is also called delayed fracture due to the mode of the occurrence of fracture. It is generally known that hydrogen embrittlement cracking is more likely to occur in the steel sheet as the tensile strength of the steel sheet increases. It is considered that this is because the higher the tensile strength of the steel sheet, the greater residual stress in the steel sheet after a component is formed. Susceptibility to the hydrogen embrittlement cracking (delayed fracture) is called hydrogen embrittlement resistance.

In Patent Document 1, bendability is considered, but the hydrogen embrittlement resistance is not considered.

In Patent Documents 2 and 3, there is room for further improvement in the hydrogen embrittlement resistance.

The present invention has been made in view of the above-mentioned problems. An object of the present invention is to provide a hot-stamp formed body that has high strength and high hydrogen embrittlement resistance.

Means for Solving the Problem

The gist of the present invention is as follows.

(1) According to an aspect of the present invention, there is provided a hot-stamp formed body including, as a chemical composition, by mass %:

C: 0.42% to 0.70%;
Si: 0.010% to 1.300%;
Mn: 0.100 to 3.000%;
P: 0.100% or less;
S: 0.0100% or less;
N: 0.0200% or less;
O: 0.0200% or less;
Al: 0.001% to 0.500%;
Cr: 0.010% to 0.800%;
Ti: 0.010% to 0.100%;
Nb: 0.0010% to 0.1000%;
B: 0.0005% to 0.0200%;
Mo: 0% to 1.000%;
Co: 0% to 4.00%;
Ni: 0% to 3.00%;
Cu: 0% to 3.00%;
V: 0% to 1.00%;
W: 0% to 1.00%;
Ca: 0% to 1.0000%;
Mg: 0% to 1.0000%;
REM: 0% to 1.0000%;
Sb: 0% to 1.00%;
Zr: 0% to 1.00%;
Sn: 0% to 1.00%;
As: 0% to 1.0000%; and
a remainder: Fe and impurities.

The hot-stamp formed body has a microstructure including, by area ratio, martensite: 90% to 100% and a remainder in the microstructure: 0% to 10%. A percentage of martensite having a GAIQ value of 40000 or less in all of the martensite is less than 5.0%, an average grain size of prior austenite grains is 6.0 μm or less, and a standard deviation of grain sizes of the prior austenite grains is 2.6 μm or less.

(2) In the hot-stamp formed body according to (1), the chemical composition may contain, by mass %, one or two or more elements selected from the group consisting of:

Mo: 0.001% to 1.000%,
Co: 0.01% to 4.00%;
Ni: 0.01% to 3.00%;

Cu: 0.01% to 3.00%;
V: 0.01% to 1.00%;
W: 0.01% to 1.00%;
Ca: 0.0001% to 1.0000%;
Mg: 0.0001% to 1.0000%;
REM: 0.0001% to 1.0000%;
Sb: 0.001% to 1.00%;
Zr: 0.001% to 1.00%;
Sn: 0.001% to 1.00%; and
As: 0.0001% to 1.0000%.

(3) In the hot-stamp formed body according to (1) or (2), the average grain size of the prior austenite grains may be more than 3.0 μm.

Effects of the Invention

According to the above-described aspect of the present invention, it is possible to provide a hot-stamp formed body having high strength and high hydrogen embrittlement resistance.

BRIEF DESCRIPTION OF THE DRAWINGS

FIG. 1 is a diagram showing a shape of a test piece used for evaluating hydrogen embrittlement resistance.

EMBODIMENTS OF THE INVENTION

The present inventors found that hydrogen embrittlement resistance of a hot-stamp formed body could be improved by reducing the average grain size and the standard deviation of the grain sizes of prior austenite grains and reducing the amount of martensite having a region with a locally high dislocation density.

The present inventors found that, in order to obtain a hot-stamp formed body having the above-described characteristics, it was effective to perform a heat treatment a plurality of times under desired conditions, particularly, in heating before hot stamping.

A hot-stamp formed body according to this embodiment will be described in detail below. First, the reason why a chemical composition of the hot-stamp formed body according to this embodiment is to be limited will be described.

In addition, a limited numerical range described using "to", which will be described below, includes a lower limit and an upper limit. Numerical values represented by "less than" or "more than" are not included in a numerical range. All percentages (%) related to the chemical composition indicate mass %.

The hot-stamp formed body according to this embodiment contains, as a chemical composition, by mass %, C: 0.42% to 0.70%, Si: 0.010% to 1.300%, Mn: 0.100% to 3.000%, P: 0.100% or less, S: 0.0100% or less, N: 0.0200% or less, O: 0.0200% or less, Al: 0.0010 to 0.5000%, Cr: 0.010% to 0.800%, Nb: 0.0010% to 0.1000%, Ti: 0.010% to 0.100%, B: 0.0005% to 0.0200%, and a remainder: Fe and impurities.

Hereinafter, each element will be described.

C: 0.42% to 0.70%

C is an element that improves the strength of the hot-stamp formed body. In a case where a C content is less than 0.42%, it is not possible to obtain the desired strength of the hot-stamp formed body. Therefore, the C content is set to 0.42% or more. The C content is preferably 0.44% or more, 0.45% or more, or 0.50% or more.

On the other hand, in a case where the C content is more than 0.70%, it is not possible to obtain high hydrogen embrittlement resistance. Therefore, the C content is set to 0.70% or less. The C content is preferably 0.65% or less, 0.60% or less, or 0.55% or less.

Si: 0.010% to 1.300%

Si is an element that improves the strength of the hot-stamp formed body by solid solution strengthening. When a Si content is less than 0.010%, it is not possible to obtain desired strength. Therefore, the Si content is set to 0.010% or more. The Si content is preferably 0.050% or more, 0.100% or more, 0.200% or more, 0.300% or more, 0.400% or more, or 0.500% or more.

On the other hand, when the Si content is more than 1.300%, the amount of ferrite increases, and it is not possible to obtain a desired microstructure. Therefore, the Si content is set to 1.300% or less. The Si content is preferably 1.100% or less, 0.900% or less, 0.700% or less, or 0.600% or less.

Mn: 0.100% to 3.000%

Mn is an element that improves hardenability of steel. A Mn content is set to 0.100% or more in order to improve the hardenability and to obtain the desired strength of the hot-stamp formed body. The Mn content is preferably 0.200% or more, 0.250% or more, 0.300% or more, 0.350% or more, or 0.400% or more.

On the other hand, when the Mn content is more than 3.000%, cracking caused by Mn segregation is likely to occur, and it is not possible to obtain high hydrogen embrittlement resistance. Therefore, the Mn content is set to be 3.000% or less. Preferably, the Mn content is 2.700% or less, 2.500% or less, 2.300% or less, 2.000% or less, 1.600% or less, 1.200% or less, 0.900% or less, or 0.600% or less.

P: 0.100% or Less

P is an impurity element and is segregated at a grain boundary to serve as the origin of fracture. Therefore, a P content is set to 0.100% or less. The P content is preferably 0.050% or less, 0.030% or less, or 0.020% or less.

The lower limit of the P content does not need to be particularly specified, but is 0%. However, when the P content is reduced to less than 0.0001%, a dephosphorization cost increases significantly, which is not preferable economically. Therefore, the P content may be set to 0.0001% or more, 0.001% or more, 0.003% or more, or 0.005% or more.

S: 0.0100% or Less

S is an impurity element and forms an inclusion in steel. Since the inclusion serves as the origin of fracture, a S content is set to 0.0100% or less. The S content is preferably 0.0080% or less, 0.0050% or less, 0.0030% or less, or 0.0020% or less.

The lower limit of the S content does not need to be particularly specified, but is 0%. However, when the S content is reduced to less than 0.0001%, a desulfurization cost increases significantly, which is not preferable economically. Therefore, the S content may be set to 0.0001% or more, 0.0002% or more, or 0.0003% or more.

N: 0.0200% or Less

N is an impurity element and forms a nitride in steel. Since the nitride serves as the origin of fracture, an N content is set to 0.0200% or less. The N content is preferably 0.0100% or less, 0.0080% or less, or 0.0050% or less.

The lower limit of the N content does not need to be particularly specified, but is 0%. However, when the N content is reduced to less than 0.0001%, a denitrification cost increases significantly, which is not preferable economically. Therefore, the N content may be set to 0.0001% or more, 0.0004% or more, 0.0008% or more, or 0.0012% or more.

O: 0.0200% or Less

When a large amount of O is included in steel, O forms a coarse oxide that serves as the origin of fracture and deteriorates the hydrogen embrittlement resistance of the hot-stamp formed body. Therefore, an O content is set to 0.0200% or less. The O content is preferably set to 0.0080% or less, 0.0050% or less, or 0.0030% or less.

The lower limit of the O content does not need to be particularly specified, but is 0%. The O content may be 0.0005% or more or 0.0010% or more to disperse a large number of fine oxides when molten steel is deoxidized.

Al: 0.001% to 0.500%

Al is an element that has an action of deoxidizing molten steel and achieving soundness of the steel (suppressing the occurrence of defects, such as blowholes, in the steel). When an Al content is less than 0.001%, deoxidation is not sufficiently performed, and a coarse oxide is formed. As a result, the above-described effect is not obtained. Therefore, the Al content is set to 0.001% or more. The Al content is preferably 0.005% or more, 0.010% or more, 0.015% or more, 0.020% or more, or 0.025% or more.

On the other hand, when the Al content is more than 0.500%, a coarse oxide is formed in steel. As a result, the hydrogen embrittlement resistance of the hot-stamp formed body is reduced. Therefore, the Al content is set to 0.500% or less. The Al content is preferably 0.400% or less, 0.300% or less, 0.200% or less, 0.150% or less, 0.100% or less, or 0.075% or less.

Further, in this embodiment, the Al content refers to a total Al content.

Cr: 0.010% to 0.800%

Cr is an element that dissolves into prior austenite grains during heating before hot stamping to increase the strength of the hot-stamp formed body. When a Cr content is less than 0.010%, it is not possible to obtain desired strength. Therefore, the Cr content is set to 0.010% or more. The Cr content is preferably set to 0.100% or more or 0.200% or more.

On the other hand, when the Cr content is more than 0.800%, the hydrogen embrittlement resistance of the hot-stamp formed body deteriorates. Therefore, the Cr content is set to 0.800% or less. The Cr content is preferably 0.700% or less, 0.650% or less, 0.600% or less, and 0.550% or less.

Ti: 0.010% to 0.100%

Ti is an element that forms a carbonitride in steel to improve the strength of the hot-stamp formed body by precipitation hardening. When a Ti content is less than 0.010%, it is not possible to obtain desired strength. The Ti content is preferably 0.020% or more or 0.025% or more.

On the other hand, when the Ti content is more than 0.100%, a large amount of carbonitride is formed in steel, and the hydrogen embrittlement resistance of the hot-stamp formed body deteriorates. Therefore, the Ti content is set to 0.100% or less. The Ti content is preferably 0.080% or less, 0.060% or less, 0.045% or less, or 0.035% or less.

Nb: 0.0010% to 0.1000%

Nb is an element that forms a carbonitride in steel to improve the strength of the hot-stamp formed body by precipitation hardening. When a Nb content is less than 0.0010%, it is not possible to obtain desired strength. Therefore, the Nb content is set to 0.0010% or more. The Nb content is preferably 0.0050% or more, 0.0090% or more, or 0.0150% or more.

On the other hand, when the Nb content is more than 0.1000%, a large amount of carbonitride is formed in steel, and the hydrogen embrittlement resistance of the hot-stamp formed body deteriorates. Therefore, the Nb content is set to 0.1000% or less. The Nb content is preferably 0.0800% or less, 0.0600% or less, or 0.0500% or less.

B: 0.0005% to 0.0200%

B is an element that improves the hardenability of steel. When a B content is less than 0.0005%, it is not possible to obtain desired strength. Therefore, the B content is set to 0.0005% or more. The B content is preferably 0.0010% or more or 0.0015% or more.

On the other hand, when the B content is more than 0.0200%, the hydrogen embrittlement resistance of the hot-stamp formed body deteriorates. Therefore, the B content is set to 0.0200% or less. The B content is preferably 0.0080% or less, 0.0060% or less, 0.0040% or less, and 0.0030% or less.

The remainder of the chemical composition of the hot-stamp formed body may be Fe and impurities. Exemplary examples of the impurities include elements which are unavoidably mixed from a steel raw material or a scrap and/or during the manufacture of steel and which are allowed in a range in which the characteristics of the hot-stamp formed body according to this embodiment do not deteriorate.

The chemical composition of the hot-stamp formed body may contain the following elements as any elements, instead of a part of Fe. In a case where the following any elements are not contained, the content is 0%.

Mo: 0.001% to 1.000%

Mo is an element that dissolves into prior austenite grains during heating before hot stamping to increase the strength of the hot-stamp formed body. In the case of reliably obtaining this effect, a Mo content is preferably set to 0.001% or more.

On the other hand, when the Mo content is more than 1.000%, the hydrogen embrittlement resistance of the hot-stamp formed body deteriorates. Therefore, the Mo content is set to 1.000% or less. The Mo content is preferably 0.800% or less or 0.600% or less.

Co: 0.01% to 4.00%

Co is an element that improves the strength of the hot-stamp formed body by solid solution strengthening. In the case of reliably obtaining this effect, a Co content is preferably set to 0.01% or more.

Meanwhile, the above-described effect is saturated even when a large amount of Co is contained. Therefore, the Co content is set to 4.00% or less.

Ni: 0.01% to 3.00%

Ni has an action of dissolving into prior austenite grains during heating before hot stamping to increase the strength of the hot-stamp formed body. In the case of reliably obtaining this effect, a Ni content is preferably set to 0.01% or more.

Meanwhile, the above-described effect is saturated even when a large amount of Ni is contained. Therefore, the Ni content is set to 3.00% or less. The Ni content is preferably 2.00% or less, 1.00% or less, 0.60% or less, or 0.30% or less.

Cu: 0.01% to 3.00%

Cu has an action of dissolving into prior austenite grains during heating before hot stamping to increase the strength of the hot-stamp formed body. In the case of reliably obtaining this effect, a Cu content is preferably set to 0.01% or more.

Meanwhile, the above-described effect is saturated even when a large amount of Cu is contained. Therefore, the Cu content is set to 3.00% or less. The Cu content is preferably 2.00% or less, 1.00% or less, 0.60% or less, or 0.30% or less.

V: 0.01% to 1.00%

V has an effect of forming a carbonitride in steel to improve the strength of the hot-stamp formed body by precipitation hardening. In the case of reliably obtaining this effect, a V content is set to 0.01% or more.

On the other hand, in a case where the V content is more than 1.00%, a large amount of carbonitride is formed in steel, and the hydrogen embrittlement resistance of the hot-stamp formed body deteriorates. Therefore, the V content is set to 1.00% or less. The V content is preferably 0.80% or less, 0.60% or less, or 0.30% or less.

W: 0.01% to 1.00%

W has an effect of improving the strength of the hot-stamp formed body. In the case of reliably obtaining this effect, a W content is preferably set to 0.01% or more. Meanwhile, the above-described effect is saturated even when a large amount of W is contained. Therefore, the W content is set to 1.00% or less. The W content is preferably 0.80% or less, 0.60% or less, or 0.30% or less.

Ca: 0.0001% to 1.0000%

Ca is an element that suppresses the formation of an oxide serving as the origin of fracture. In the case of reliably obtaining this effect, a Ca content is preferably set to 0.0001% or more.

Meanwhile, the above-described effect is saturated even when a large amount of Ca is contained. Therefore, the Ca content is set to 1.0000% or less. The Ca content is preferably 0.4000% or less, 0.1000% or less, 0.0500% or less, 0.0200% or less, 0.0100% or less, or 0.0070% or less.

Mg: 0.0001% to 1.0000%

Mg has the effects of forming an oxide or a sulfide in molten steel, suppressing the formation of coarse MnS, dispersing a large number of fine oxides, and refining a microstructure. In the case of reliably obtaining these effects, a Mg content is preferably set to 0.0001% or more.

On the other hand, when the Mg content is more than 1.0000%, the amount of oxide in steel increases, which adversely affects the toughness of the hot-stamp formed body. Therefore, the Mg content is set to 1.0000% or less. The Mg content is preferably 0.4000% or less, 0.1000% or less, 0.0500% or less, 0.0200% or less, 0.0100%, or 0.070% or less.

REM: 0.0001% to 1.0000%

REM is an element that suppresses the formation of an oxide serving as the origin of fracture. In the case of reliably obtaining this effect, a REM content is preferably set to 0.0001% or more.

Meanwhile, the above-described effect is saturated even when a large amount of REM is contained. Therefore, the REM content is set to 1.0000% or less. The REM content is preferably 0.4000% or less, 0.1000% or less, 0.0500% or less, 0.0200% or less, 0.0100%, or 0.070% or less.

Further, in this embodiment, the REM refers to a total of 17 elements consisting of Sc, Y, and lanthanoid, and the REM content refers to the total content of these elements.

Sb: 0.001% to 1.00%.

Sb suppresses the formation of an oxide serving as the origin of fracture to improve the deformability of the hot-stamp formed body. In the case of reliably obtaining this effect, an Sb content is preferably set to 0.001% or more.

Meanwhile, the above-described effect is saturated even when a large amount of Sb is contained. Therefore, the Sb content is set to 1.00% or less. The Sb content is preferably 0.4000% or less, 0.1000% or less, 0.0500% or less, 0.0200% or less, 0.0100%, or 0.070% or less.

Zr: 0.001% to 1.00%

Zr is an element that contributes to inclusion control, particularly, fine dispersion of inclusions and that increases the toughness of the hot-stamp formed body. In the case of reliably obtaining this effect, a Zr content is preferably set to 0.001% or more.

Meanwhile, when a large amount of Zr is contained, surface properties may deteriorate. Therefore, the Zr content is set to 1.00% or less. The Zr content is preferably 0.4000% or less, 0.1000% or less, 0.0500% or less, 0.0200% or less, 0.0100%, or 0.070% or less.

Sn: 0.001% to 1.00%

Sn suppresses the formation of an oxide serving as the origin of fracture and contributes to improvement of the hydrogen embrittlement resistance. In the case of reliably obtaining this effect, a Sn content is preferably set to 0.001% or more.

Meanwhile, the above-described effect is saturated even when a large amount of Sn is contained. Therefore, the Sn content is set to 1.00% or less. The Sn content is preferably 0.4000% or less, 0.1000% or less, 0.0500% or less, 0.0200% or less, 0.0100%, or 0.070% or less.

As: 0.0001% to 1.0000%.

As lowers an austenite single phase temperature to refine prior austenite grains and contributes to the improvement of the hydrogen embrittlement resistance. In the case of reliably obtaining this effect, an As content is preferably set to 0.0001% or more.

Meanwhile, the above-described effect is saturated even when a large amount of As is contained. Therefore, the As content is set to 1.0000% or less. The As content is preferably 0.4000% or less, 0.1000% or less, 0.0500% or less, 0.0200% or less, 0.0100%, or 0.070% or less.

The chemical composition of the hot-stamp formed body may be measured by a general analysis method. For example, the chemical composition may be measured using inductively coupled plasma-atomic emission spectrometry (ICP-AES). In addition, C and S may be measured using a combustion-infrared absorption method, N may be measured using an inert gas fusion-thermal conductivity method, and O may be measured using an inert gas fusion-nondispersive infrared absorption method.

In a case where a plating layer is provided on a surface of the hot-stamp formed body, the chemical composition of the hot-stamp formed body may be analyzed after the plating layer is removed by mechanical grinding.

Next, the microstructure of the hot-stamp formed body according to this embodiment will be described.

The microstructure of the hot-stamp formed body according to this embodiment includes, by area ratio, martensite: 90% to 100% and the remainder in the microstructure: 0% to 10%. In all of the martensite, the percentage of martensite having a GAIQ value of 40000 or less is less than 5.0%. The average grain size of the prior austenite grains is 6.0 μm or less, and the standard deviation of the grain sizes of the prior austenite grains is 2.6 μm or less.

In this embodiment, a microstructure at a ¼ thickness position from the surface (a region from a depth of ⅛ of the thickness from the surface to a depth of ⅜ of the thickness from the surface) is specified. The reason is that the microstructure at this position indicates a typical microstructure of a steel sheet.

Area Ratio of Martensite: 90% or More

When the area ratio of martensite is less than 90%, it is not possible to obtain the desired strength of the hot-stamp formed body. Therefore, the area ratio of martensite is set to 90% or more. Preferably, the area ratio of martensite is 93% or more, 95% or more, 97% or more, or 99% or more. The area ratio of martensite may be set to 100%.

The upper limit is not particularly specified, but is 100%.

The microstructure of the hot-stamp formed body may include bainite, ferrite, and residual austenite as the remainder in the microstructure. The total area ratio of the remainder in the microstructure may be 10% or less, 7% or less, 5% or less, 3% or less, or 1% or less. The total area ratio of the remainder in the microstructure may be set to 0%.

The microstructure of the hot-stamp formed body is measured by the following method.

A sample is cut out from any position that is 50 mm or more away from an end surface of the hot-stamp formed body (a position that avoids an end portion in a case where it is not possible to collect the sample at this position) such that a sheet thickness cross section parallel to a rolling direction can be observed. The size of the sample also depends on a measurement device, but is set to a size where about 10 mm can be observed in the rolling direction.

The cross section of the sample is polished using #600 to #1500 silicon carbide paper and is then mirror-finished using a liquid obtained by dispersing diamond powder having a grain size of 1 μm to 6 μm in a diluted solution, such as alcohol, or pure water. Then, the cross section is polished for eight minutes at room temperature, using colloidal silica having a grain size of 0.25 μm which does not include an alkaline solution, to remove strain introduced into a surface layer of the sample. At any position of the cross section of the sample in a longitudinal direction, a region that has a length of 50 μm and extends from a depth of ⅛ of the thickness from the surface to a depth of ⅜ of the thickness from the surface is measured at a measurement interval of 0.1 μm by an electron backscatter diffraction method to obtain crystal orientation information. For the measurement, an EBSD analysis device composed of a thermal field emission scanning electron microscope (JSM-7001F manufactured by JEOL) and an EBSD detector (DVC5 detector manufactured by TSL) is used. At this time, the degree of vacuum inside the EBSD analysis device is set to $9.6\times10^{-5}$ Pa or less, an acceleration voltage is set to 15 kV, an irradiation current level is set to 13, and an electron beam irradiation level is set to 62.

For the obtained crystal orientation information, a region having an fcc crystal structure is determined as residual austenite using a "Phase Map" function provided in software "OIM Analysis (registered trademark)" installed in the EBSD analysis device. The area ratio of the residual austenite is calculated to obtain the area ratio of the residual austenite. Then, regions having a bcc crystal structure are determined as bainite, martensite, and ferrite. For these regions, a region in which "Grain Orientation Spread" is 1° or less is extracted as ferrite under a condition in which a 150 grain boundary is regarded as a grain boundary, using a "Grain Orientation Spread" function provided in the software "OIM Analysis (registered trademark)" installed in the EBSD analysis device. The area ratio of the extracted ferrite is calculated to obtain the area ratio of ferrite.

Then, under a condition in which a 5° grain boundary is regarded as a grain boundary in the remaining region (a region in which "Grain Orientation Spread" is more than 1°), when a maximum value of "Grain Average IQ" of a ferrite region is Iα, a region in which the maximum value is more than Iα/2 is extracted as bainite, and a region in which the maximum value is Iα/2 or less is extracted as martensite. The area ratio of the extracted bainite is calculated to obtain the area ratio of bainite. In addition, the area ratio of the extracted martensite is calculated to obtain the area ratio of martensite.

In a case where ferrite is not extracted in an observed visual field, under a condition in which a 5° grain boundary is regarded as the grain boundary, a region in which "Grain Average Misorientation" is more than 0.50° and is 0.75° or less is extracted as bainite, and a region in which "Grain Average Misorientation" is more than 0.75° is extracted as martensite and tempered martensite in the same visual field, using a GAM "Grain Average Misorientation" function. The area ratios of the extracted elements are calculated to obtain the area ratio of bainite and the total area ratio of martensite and tempered martensite.

Percentage of Martensite Having GAIQ Value of 40000 or Less in all of Martensite: Less than 5.0%

The larger the GAIQ value, the lower the dislocation density. In addition, the smaller the GAIQ value, the higher the dislocation density. Therefore, the GAIQ value is a parameter that can reflect the dislocation density of crystal grains.

When the percentage of martensite having a GAIQ value of 40000 or less in all of the martensite is 5.0% or more, the hydrogen embrittlement resistance of the hot-stamp formed body deteriorates. Therefore, the percentage of martensite having a GAIQ value of 40000 or less in all of the martensite is set to less than 5.0%. The percentage of martensite is preferably 4.0% or less, 3.0% or less, or 2.0% or less and may be 0.0%.

The percentage of martensite having a GAIQ value of 40000 or less in all of the martensite is obtained by the following method.

A sample is cut out from a position that is 50 mm or more away from the end surface of the hot-stamp formed body (a position that avoids an end portion in a case where it is not possible to collect the sample at this position) such that a sheet thickness cross section can be observed. The sheet thickness cross section of the sample is polished using #600 to #1500 silicon carbide paper and is then mirror-finished using a liquid obtained by dispersing diamond powder having a grain size of 1 μm to 6 μm in a diluted solution, such as alcohol, or pure water. Then, the sheet thickness cross section is polished for eight minutes at room temperature, using colloidal silica having a grain size of 0.25 μm which does not include an alkaline solution, to remove strain introduced into a surface layer of the sample.

At any position of the sheet thickness cross section of the sample in the longitudinal direction, a region that has a length of 50 μm and is at a ¼ thickness position (a region from a depth of ⅛ of the thickness from the surface to a depth of ⅜ of the thickness from the surface) is measured at a measurement interval of 0.1 μm by the electron backscatter diffraction method to obtain crystal orientation information. For the measurement, an EBSD analysis device composed of a thermal field emission scanning electron microscope (JSM-7001F manufactured by JEOL) and an EBSD detector (DVC5 detector manufactured by TSL) is used. At this time, the degree of vacuum inside the EBSD analysis device is set to $9.6\times10^{-5}$ Pa or less, the acceleration voltage is set to 15 kV, an operating distance is set to 15 mm, the irradiation current level is set to 13, and the electron beam irradiation level is set to 62.

For the obtained crystal orientation information, a grain average image quality map (GAIQ map) is obtained using a software "OIM Data Collection" function provided in the EBSD analysis device and a "Grain Average Misorientation" function provided in "OIM Analysis (registered trademark)

". Here, in the OIM Data Collection, among camera settings, EXPOSURE TIME is set to 3.65, and Gain is set to 0.39. In addition, when a band of an EBSD pattern is detected, Max Peak Count of the Hough transform is set to 9. In the obtained GAIQ map, a region having a crystal orientation difference of 5° or more is defined as a crystal grain, and the area ratio of martensite having a GAIQ value of 40000 or less is calculated. The area ratio of martensite having a GAIQ value of 40000 or less is calculated for a total of 10 observed visual fields. An average value of the obtained area ratios is calculated to obtain the area ratio of martensite having a GAIQ value of 40000 or less. The obtained area ratio is divided by the area ratio of martensite obtained by the above-described method to obtain the percentage of martensite having a GAIQ value of 40000 or less in all of the martensite. In addition, the region having a GAIQ value of 40000 or less may include bainite in addition to martensite. Therefore, martensite is identified by the above-described method, and the area ratio of martensite having a GAIQ value of 40000 or less in the identified martensite is measured.

Average Grain Size of Prior Austenite Grains: 6.0 μm or Less

A grain boundary area is increased, and the amount of hydrogen per unit grain boundary area is decreased by reducing the average grain size of the prior austenite grains. This makes it possible to improve the hydrogen embrittlement resistance of the hot-stamp formed body. When the average grain size of the prior austenite grains is more than 6.0 μm, the hydrogen embrittlement resistance of the hot-stamp formed body deteriorates. Therefore, the average grain size of the prior austenite grains is set to 6.0 μm or less. The average grain size is preferably 5.5 μm or less or 5.0 μm or less.

The lower limit is not particularly specified, but may be set to 2.0 μm or more. The average grain size of the prior austenite grains is preferably more than 3.0 μm. The average grain size of the prior austenite grains is more preferably 3.3 μm or more, 3.6 μm or more, 3.9 μm or more, 4.2 μm or more, 4.5 μm or more, or 4.7 μm or more.

Standard Deviation of Grain Sizes of Prior Austenite Grains: 2.6 μm or Less

An increase in local residual stress can be suppressed by reducing the unevenness of the grain sizes of the prior austenite grains, that is, by reducing the standard deviation. As a result, it is possible to improve the hydrogen embrittlement resistance of the hot-stamp formed body. When the standard deviation of the grain sizes of the prior austenite grains is more than 2.6 μm, the hydrogen embrittlement resistance deteriorates. Therefore, the standard deviation of the grain sizes of the prior austenite grains is set to 2.6 μm or less. The standard deviation is more preferably 2.4 μm or less, 2.2 μm or less, or 2.0 μm or less.

The lower limit of the standard deviation of the grain sizes of the prior austenite grains does not need to be particularly limited, but may be set to 1.0 μm.

The average grain size and the standard deviation of the grain sizes of the prior austenite grains are obtained by the following method.

A sample is cut out from any position that is 50 mm or more away from an end surface of the hot-stamp formed body (a position that avoids an end portion in a case where it is not possible to collect the sample at this position) such that a sheet thickness cross section parallel to a rolling direction can be observed. The size of the sample also depends on a measurement device, but is set to a size where about 10 mm can be observed in the rolling direction.

Then, for the sheet thickness cross section of the sample, a structure is exposed by an etchant obtained by adding a sodium dodecylbenzene sulfonate etchant to a saturated aqueous solution of picric acid. At any position of the sample in the longitudinal direction, a region that has a length of 50 μm and is at a ¼ thickness position from the surface (a region from a depth of ⅛ of the thickness from the surface to a depth of ⅜ of the thickness from the surface) is imaged by a scanning electron microscope at a magnification of 500 times to obtain a structure photograph. Circle equivalent diameters of the prior austenite grains are measured using the structure photograph.

In addition, the scanning electron microscope needs to be equipped with a two-electron detector. For the capture of the structure photograph, the sample is irradiated with an electron beam under the conditions of a vacuum of $9.6\times10^{-5}$ Pa or less, an acceleration voltage of 15 kV, and an irradiation current level of 13 to capture a secondary electron image. The number of visual fields captured is set to 10 or more. In the captured secondary electron image, the prior austenite grain boundaries are captured with high contrast. The circle equivalent diameter is calculated for one of the prior austenite grains included in the observed visual field. The above-described operation is performed on all of the prior austenite grains that are included in the observed visual field except for prior austenite grains that are not fully included in the captured visual field, such as prior austenite grains in an end portion of the captured visual field, to calculate the circle equivalent diameters of all of the prior austenite grains in the captured visual field. The average value of the obtained circle equivalent diameters of the prior austenite grains is calculated to obtain the average grain size of the prior austenite grains. In addition, the standard deviation is calculated from the obtained circle equivalent diameters of the prior austenite grains to obtain the standard deviation of the grain sizes of the prior austenite grains.

The hot-stamp formed body according to this embodiment may have a plating layer on the surface. The plating layer provided on the surface makes it possible to improve corrosion resistance after hot stamping. Exemplary examples of the plating layer include an aluminum plating layer, an aluminum-zinc plating layer, an aluminum-silicon plating layer, a hot-dip galvanized layer, an electrogalvanized layer, and a hot-dip galvannealed layer.

Next, a steel sheet for hot stamping for obtaining the hot-stamp formed body according to this embodiment will be described.

The steel sheet for hot stamping has the above-described chemical composition. The microstructure of the steel sheet for hot stamping is not particularly limited as long as desired strength and hydrogen embrittlement resistance can be obtained after hot stamping. For example, the microstructure may consist of, by area ratio, ferrite: 0% to 90%, bainite and martensite: 0% to 100%, pearlite: 0% to 80%, and residual austenite: 0% to 5%.

In addition, the steel sheet for hot stamping may have a plating layer on a surface. The plating layer provided on the surface makes it possible to improve corrosion resistance after hot stamping. Exemplary examples of the plating layer include an aluminum plating layer, an aluminum-zinc plating layer, an aluminum-silicon plating layer, a hot-dip galvanized layer, an electrogalvanized layer, and a hot-dip galvannealed layer.

Method for Manufacturing Steel Sheet for Hot Stamping

Hereinafter, a method for manufacturing the steel sheet for hot stamping for obtaining the hot-stamp formed body according to this embodiment will be described. Manufacturing conditions of the steel sheet for hot stamping are not particularly limited, and the steel sheet for hot stamping may be manufactured under normal conditions.

The hot-stamp formed body according to this embodiment is obtained by hot-stamping the steel sheet for hot stamping. In order to obtain the hot-stamp formed body according to this embodiment, it is effective to perform a heat treatment (including hot stamping performed at a final stage) on the steel sheet for hot stamping three or more times.

In addition, all of the temperatures which will be described below are the surface temperatures of the steel sheet.

First Heat Treatment

In a first heat treatment, the steel sheet for hot stamping is heated to a temperature range of an $Ac_3$ point to "the $Ac_3$ point+200° C.", is held in the temperature range, and is then cooled to a temperature range of 250° C. to 350° C.

In addition, the $Ac_3$ point is represented by the following expression.

$$Ac_3(°\ C.)=910-203\times C^{0.5}+66\times Si-25\times Mn+700\times P-11\times Cr+109\times Al+400\times Ti-15.2\times Ni+104\times V+31.5\times Mo \quad (1)$$

A symbol of an element in the above-described expression indicates the content of each element by mass %. In a case where the element is not contained, 0 is substituted to the symbol of the element.

When the heating temperature is lower than the $Ac_3$ point or higher than "the $Ac_3$ point+200° C.", it is not possible to sufficiently dissolve the carbide. As a result, the average grain size and the standard deviation of the grain sizes of the prior austenite grains may not be preferably controlled. Therefore, the heating temperature is set in the temperature range of the $Ac_3$ point to "the $Ac_3$ point+200° C.".

An average heating rate up to the above-described temperature range is set to 2° C./s or faster. When the average heating rate is slower than 2° C./s, the prior austenite grains are coarsened while the temperature rises, and it is not possible to refine the prior austenite grains of the hot-stamp formed body even when a second heat treatment which will be described below is performed.

A heating method is not particularly limited, and exemplary examples of the heating method include atmospheric heating, electric heating, and infrared heating.

A holding time in the above-described temperature range is set to 1 second or longer. When the holding time is shorter than 1 second, the carbide is not sufficiently dissolved. When the holding time is longer than 600 seconds, the effect is saturated, productivity is lowered, and a cost is increased. Therefore, the holding time is set to 600 seconds or shorter.

After the steel sheet for hot stamping is held in the above-described temperature range, cooling is performed to a temperature range of 250° C. to 350° C. at an average cooling rate of 10° C./s or faster. When the average cooling rate is slower than 10° C./s, pearlite including coarse and plate-like carbides is formed, and the carbides are not sufficiently dissolved in the third and subsequent heat treatments. In addition, in a case where a cooling stop temperature is higher than 350° C., coarse granular carbides or plate-like carbides are formed. In the third and subsequent heat treatments, the carbides are not sufficiently dissolved, and it is not possible to obtain desired strength. When the cooling stop temperature is lower than 250° C., the carbides in the martensite are too fine, and the Ostwald ripening of the prior austenite grains proceeds in the third and subsequent heat treatments. Therefore, in some cases, it is not possible to preferably control the average grain size and the standard deviation of the grain sizes of the prior austenite grains.

Exemplary examples of the cooling having an average cooling rate of 10° C./s or faster include die and punch cooling, gas cooling, and water cooling.

After cooling to the temperature range of 250° C. to 350° C., air cooling may be performed. In addition, the air cooling described here refers to cooling in which the average cooling rate is slower than 10° C./s.

Second Heat Treatment

A second heat treatment is performed under the same conditions as the first heat treatment.

However, in either the first heat treatment or the second heat treatment, the cooling stop temperature is set to 260° C. or higher. When the cooling stop temperature in either the first heat treatment or the second heat treatment is not 260° C. or higher, it is not possible to preferably control the average grain size and the standard deviation of the grain sizes of the prior austenite grains.

Third Heat Treatment

In a third heat treatment, the steel sheet for hot stamping is heated to the temperature range of the $Ac_3$ point to "the $Ac_3$ point+200° C.", is held in the temperature range, and is then cooled to a temperature range of 250° C. or lower at an average cooling rate of 10° C./s or faster. Since the third heat treatment is the same as the first heat treatment and the second heat treatment except that cooling is performed to the temperature range of 250° C. or lower, the description thereof will be omitted.

The performance of the third heat treatment under the above-described conditions makes it possible to finely disperse carbides in the martensite. Therefore, it is possible to reduce the average grain size and the standard deviation of the grain sizes of the prior austenite grains.

Further, in the third heat treatment, after the steel sheet for hot stamping is heated in the temperature range of the $Ac_3$ point to "the $Ac_3$ point+200° C." and held in the temperature range, hot stamping may be performed. At this time, the average cooling rate up to the temperature range of 250° C. or lower may be 10° C./s or faster due to contact with a die and punch.

Further, in a case where hot stamping is not performed in the third heat treatment, after the third heat treatment, a heat treatment may be performed a plurality of times under the same conditions as the third heat treatment. As the number of heat treatments increases, it is possible to further reduce the average grain size and the standard deviation of the grain sizes of the prior austenite grains.

In this case, in the final heat treatment, after the steel sheet for hot stamping is heated to the temperature range of the $Ac_3$ point to "the $Ac_3$ point+200° C." and held in the temperature range, hot stamping may be performed. At this time, the average cooling rate up to the temperature range of 250° C. or lower may be 10° C./s or faster due to contact with a die and punch.

The hot-stamp formed body according to this embodiment is obtained by the above-described method. In addition, after the formation by hot stamping, a tempering treatment may be performed at 150° C. to 600° C. In addition, a part of the hot-stamp formed body may be tempered by, for example, laser irradiation to partially provide a softened region.

EXAMPLES

Next, examples of the present invention will be described. Conditions in the examples are one condition example that is employed to confirm the feasibility and effects of the present invention, and the present invention is not limited to this condition example. The present invention may employ various conditions to achieve the object of the present invention without departing from the scope of the present invention.

Hot rolling and cold rolling were performed on slabs manufactured by casting molten steels having chemical compositions shown in Tables 1A to 1C to obtain steel sheets for hot stamping.

Heat treatments were performed on the obtained steel sheets for hot stamping under the conditions shown in Tables 2A to 2D to obtain hot-stamping formed bodies shown in Tables 3A to 3D. In addition, in all of the heat treatments, the average heating rate up to the heating temperature was 2° C./s or faster, the holding time at the heating temperature was 1 to 600 seconds, the average cooling rate from the heating temperature to the cooling stop temperature was 10° C./s or faster, and air cooling (the average cooling rate was slower than 10° C./s) was performed after the cooling was stopped.

Further, underlines in the tables indicate that the values are out of the scope of the present invention, that preferred manufacturing conditions are not satisfied, and that property values are not preferable.

The microstructure of the hot-stamp formed body was measured by the above-mentioned measurement method. In addition, the mechanical properties of the hot-stamp formed body were evaluated by the following method.

Tensile Strength

Tensile strength TS of the hot-stamp formed body was obtained by producing a No. 5 test piece from any position of the hot-stamp formed body according to JIS Z 2241:2011 and performing a tensile test. In addition, a cross-head speed was set to 3 mm/min. A case where the tensile strength was 2300 MPa or more was determined as "pass" since the tensile strength was high. A case where the tensile strength was less than 2300 MPa was determined as "fail" in the test since the tensile strength was not high.

Hydrogen Embrittlement Resistance

FIG. 1 shows the shape of a test piece used for evaluating the hydrogen embrittlement resistance. The test piece shown in FIG. 1 provided with a V-notch was immersed at room temperature in an aqueous solution obtained by dissolving 5 g/l of ammonium thiocyanate in 3% by volume of saline, and the hydrogen embrittlement resistance was determined on the basis of on the presence or absence of fracture after 12 hours, 18 hours, and 24 hours. In addition, a load that was 40% of the tensile strength obtained in the tensile test was applied to the V-notch of the test piece in advance. A case where there was no fracture even after immersion for 12 hours or longer was determined as "pass". Specifically, a case where fracture did not occur after 12 hours and occurred after 18 hours was written as "Fair", a case where fracture did not occur after 18 hours and occurred after 24 hours was written as "Good", and a case where fracture did not occur after 24 hours was written as "Very Good". A case where fracture occurred after 12 hours was determined as "fail" and was written as "Bad" in the tables.

TABLE 1A

| Steel | Chemical composition (mass %) Remainder Fe and Impurities | | | | | | | | | | | | | $Ac_3$ | |
|---|---|---|---|---|---|---|---|---|---|---|---|---|---|---|---|
| No | C | Si | Mn | P | S | N | O | Al | Cr | Ti | Nb | B | Others | (° C.) | Remarks |
| 1 | 0.46 | 0.430 | 0.410 | 0.007 | 0.0004 | 0.0033 | 0.0015 | 0.043 | 0.270 | 0.020 | 0.0180 | 0.0022 | | 805 | Steel according to the present invention |
| 2 | 0.46 | 0.210 | 0.410 | 0.011 | 0.0009 | 0.0029 | 0.0018 | 0.045 | 0.220 | 0.026 | 0.0500 | 0.0023 | | 797 | Steel according to the present invention |
| 3 | 0.46 | 1.300 | 2.300 | 0.006 | 0.0100 | 0.0024 | 0.0020 | 0.016 | 0.420 | 0.010 | 0.0550 | 0.0005 | Mo: 0.490 | 821 | Steel according to the present invention |
| 4 | 0.43 | 0.400 | 0.480 | 0.012 | 0.0003 | 0.0030 | 0.0023 | 0.054 | 0.500 | 0.023 | 0.0443 | 0.0018 | | 810 | Steel according to the present invention |
| 5 | 0.55 | 0.322 | 0.441 | 0.014 | 0.0002 | 0.0022 | 0.0021 | 0.031 | 0.500 | 0.015 | 0.0286 | 0.0024 | | 783 | Steel according to the present invention |
| 6 | 0.70 | 0.400 | 0.441 | 0.015 | 0.0001 | 0.0026 | 0.0017 | 0.054 | 0.422 | 0.019 | 0.0365 | 0.0024 | | 775 | Steel according to the present invention |
| 7 | 0.38 | 0.361 | 0.402 | 0.013 | 0.0005 | 0.0026 | 0.0019 | 0.036 | 0.230 | 0.025 | 0.0600 | 0.0027 | | 819 | Steel according to Comparative Example |
| 8 | 0.72 | 0.200 | 0.420 | 0.013 | 0.0003 | 0.0024 | 0.0025 | 0.060 | 0.300 | 0.025 | 0.0280 | 0.0027 | | 763 | Steel according to Comparative Example |
| 9 | 0.47 | 0.020 | 0.441 | 0.015 | 0.0002 | 0.0030 | 0.0023 | 0.054 | 0.382 | 0.017 | 0.0580 | 0.0018 | | 781 | Steel according to the present invention |
| 10 | 0.45 | 0.660 | 0.480 | 0.013 | 0.0002 | 0.0030 | 0.0021 | 0.048 | 0.382 | 0.019 | 0.0600 | 0.0018 | | 823 | Steel according to the present invention |
| 11 | 0.47 | 1.300 | 0.500 | 0.011 | 0.0002 | 0.0022 | 0.0017 | 0.048 | 0.461 | 0.017 | 0.0443 | 0.0018 | | 860 | Steel according to the present invention |
| 12 | 0.43 | 0.007 | 0.420 | 0.014 | 0.0005 | 0.0034 | 0.0008 | 0.038 | 0.200 | 0.021 | 0.0330 | 0.0014 | | 788 | Steel according to Comparative Example |
| 13 | 0.43 | 1.380 | 0.430 | 0.013 | 0.0008 | 0.0027 | 0.0010 | 0.033 | 0.200 | 0.020 | 0.0340 | 0.0017 | | 876 | Steel according to Comparative Example |
| 14 | 0.47 | 0.400 | 0.050 | 0.010 | 0.0003 | 0.0024 | 0.0023 | 0.031 | 0.700 | 0.015 | 0.0365 | 0.0030 | | 805 | Steel according to the present invention |
| 15 | 0.47 | 0.361 | 1.500 | 0.015 | 0.0002 | 0.0020 | 0.0023 | 0.048 | 0.500 | 0.025 | 0.0522 | 0.0018 | | 778 | Steel according to the present invention |
| 16 | 0.45 | 0.361 | 2.950 | 0.010 | 0.0003 | 0.0026 | 0.0022 | 0.047 | 0.230 | 0.020 | 0.0430 | 0.0022 | | 741 | Steel according to the present invention |
| 17 | 0.46 | 0.420 | 0.005 | 0.008 | 0.0005 | 0.0035 | 0.0013 | 0.041 | 0.270 | 0.021 | 0.0200 | 0.0024 | | 815 | Steel according to Comparative Example |
| 18 | 0.46 | 0.240 | 3.050 | 0.011 | 0.0002 | 0.0026 | 0.0015 | 0.048 | 0.380 | 0.017 | 0.0280 | 0.0021 | | 728 | Steel according to Comparative Example |

TABLE 1A-continued

| Steel | Chemical composition (mass %) Remainder Fe and Impurities | | | | | | | | | | | | | $Ac_3$ | |
|---|---|---|---|---|---|---|---|---|---|---|---|---|---|---|---|
| No | C | Si | Mn | P | S | N | O | Al | Cr | Ti | Nb | B | Others | (° C.) | Remarks |
| 19 | 0.47 | 0.243 | 0.441 | 0.095 | 0.0001 | 0.0024 | 0.0015 | 0.054 | 0.461 | 0.015 | 0.0443 | 0.0030 | | 850 | Steel according to the present invention |
| 20 | 0.46 | 0.430 | 0.410 | 0.110 | 0.0005 | 0.0037 | 0.0012 | 0.040 | 0.280 | 0.020 | 0.0200 | 0.0025 | | 877 | Steel according to Comparative Example |
| 21 | 0.47 | 0.243 | 0.480 | 0.010 | 0.0095 | 0.0026 | 0.0023 | 0.054 | 0.343 | 0.019 | 0.0522 | 0.0024 | | 792 | Steel according to the present invention |
| 22 | 0.46 | 0.430 | 0.400 | 0.008 | 0.0130 | 0.0035 | 0.0012 | 0.040 | 0.300 | 0.020 | 0.0210 | 0.0025 | | 805 | Steel according to Comparative Example |
| 23 | 0.45 | 0.322 | 0.402 | 0.014 | 0.0003 | 0.0194 | 0.0017 | 0.0482 | 0.461 | 0.025 | 0.0522 | 0.0024 | | 805 | Steel according to the present invention |
| 24 | 0.46 | 0.430 | 0.410 | 0.007 | 0.0004 | 0.0250 | 0.0015 | 0.070 | 0.270 | 0.022 | 0.0450 | 0.0025 | | 809 | Steel according to Comparative Example |
| 25 | 0.45 | 0.361 | 0.461 | 0.014 | 0.0002 | 0.0024 | 0.0200 | 0.0365 | 0.343 | 0.025 | 0.0443 | 0.0024 | | 806 | Steel according to the present invention |

Underlines indicate that values are out of the scope of the present invention.

TABLE 1B

| Steel | Chemical composition (mass %) Remainder Fe and Impurities | | | | | | | | | | | | | $Ac_3$ | |
|---|---|---|---|---|---|---|---|---|---|---|---|---|---|---|---|
| No. | C | Si | Mn | P | S | N | O | Al | Cr | Ti | Nb | B | Others | (° C.) | Remarks |
| 26 | 0.46 | 0.410 | 0.410 | 0.009 | 0.0005 | 0.0035 | 0.0230 | 0.046 | 0.300 | 0.020 | 0.0200 | 0.0017 | | 805 | Steel according to Comparative Example |
| 27 | 0.46 | 0.330 | 0.500 | 0.011 | 0.0003 | 0.0034 | 0.0020 | 0.003 | 0.304 | 0.018 | 0.0450 | 0.0019 | | 793 | Steel according to the present invention |
| 28 | 0.46 | 0.330 | 0.500 | 0.012 | 0.0004 | 0.0033 | 0.0017 | 0.253 | 0.290 | 0.019 | 0.0440 | 0.0020 | | 822 | Steel according to the present invention |
| 29 | 0.46 | 0.322 | 0.500 | 0.011 | 0.0002 | 0.0030 | 0.0021 | 0.493 | 0.304 | 0.018 | 0.0443 | 0.0018 | | 847 | Steel according to the present invention |
| 30 | 0.46 | 0.330 | 0.500 | 0.012 | 0.0004 | 0.0033 | 0.0024 | 0.0007 | 0.270 | 0.020 | 0.0460 | 0.0023 | | 795 | Steel according to Comparative Example |
| 31 | 0.45 | 0.280 | 0.400 | 0.015 | 0.0002 | 0.0026 | 0.0019 | 0.540 | 0.340 | 0.015 | 0.0200 | 0.0030 | | 854 | Steel according to Comparative Example |
| 32 | 0.46 | 0.430 | 0.900 | 0.010 | 0.0006 | 0.0027 | 0.0017 | 0.041 | 0.030 | 0.020 | 0.0230 | 0.0027 | | 797 | Steel according to the present invention |
| 33 | 0.46 | 0.450 | 0.300 | 0.010 | 0.0005 | 0.0029 | 0.0019 | 0.041 | 0.400 | 0.020 | 0.0240 | 0.0024 | | 810 | Steel according to the present invention |
| 34 | 0.46 | 0.400 | 0.402 | 0.015 | 0.0004 | 0.0024 | 0.0021 | 0.0482 | 0.790 | 0.017 | 0.0208 | 0.0027 | | 802 | Steel according to the present invention |
| 35 | 0.43 | 0.400 | 0.420 | 0.012 | 0.0005 | 0.0030 | 0.0023 | 0.044 | 0.006 | 0.022 | 0.0443 | 0.0018 | | 816 | Steel according to Comparative Example |
| 36 | 0.47 | 0.280 | 0.460 | 0.011 | 0.0003 | 0.0030 | 0.0023 | 0.048 | 0.820 | 0.017 | 0.0280 | 0.0018 | | 789 | Steel according to Comparative Example |
| 37 | 0.46 | 0.420 | 0.420 | 0.010 | 0.0005 | 0.0026 | 0.0014 | 0.043 | 0.260 | 0.011 | 0.0190 | 0.0026 | | 803 | Steel according to the present invention |
| 38 | 0.46 | 0.420 | 0.430 | 0.011 | 0.0003 | 0.0028 | 0.0017 | 0.038 | 0.255 | 0.063 | 0.0190 | 0.0028 | | 824 | Steel according to the present invention |
| 39 | 0.45 | 0.400 | 0.402 | 0.013 | 0.0002 | 0.0030 | 0.0025 | 0.060 | 0.270 | 0.099 | 0.0210 | 0.0028 | | 842 | Steel according to the present invention |
| 40 | 0.42 | 0.300 | 0.390 | 0.012 | 0.0005 | 0.0030 | 0.0023 | 0.044 | 0.200 | 0.004 | 0.0200 | 0.0019 | | 801 | Steel according to Comparative Example |
| 41 | 0.46 | 0.390 | 0.410 | 0.012 | 0.0060 | 0.0031 | 0.0022 | 0.047 | 0.300 | 0.110 | 0.0400 | 0.0023 | | 843 | Steel according to Comparative Example |
| 42 | 0.46 | 0.430 | 0.430 | 0.010 | 0.0005 | 0.0034 | 0.0017 | 0.043 | 0.310 | 0.020 | 0.0015 | 0.0025 | | 806 | Steel according to the present invention |
| 43 | 0.45 | 0.243 | 0.461 | 0.014 | 0.0030 | 0.0026 | 0.0023 | 0.060 | 0.500 | 0.025 | 0.0970 | 0.0024 | | 799 | Steel according to the present invention |
| 44 | 0.42 | 0.300 | 0.400 | 0.012 | 0.0006 | 0.0028 | 0.0019 | 0.033 | 0.250 | 0.021 | 0.0005 | 0.0017 | | 805 | Steel according to Comparative Example |
| 45 | 0.46 | 0.400 | 0.420 | 0.011 | 0.0004 | 0.0027 | 0.0020 | 0.040 | 0.300 | 0.020 | 0.1100 | 0.0025 | | 805 | Steel according to Comparative Example |
| 46 | 0.46 | 0.300 | 0.800 | 0.010 | 0.0005 | 0.0029 | 0.0018 | 0.041 | 0.350 | 0.022 | 0.0250 | 0.0007 | | 789 | Steel according to the present invention |
| 47 | 0.46 | 0.300 | 0.420 | 0.010 | 0.0003 | 0.0030 | 0.0017 | 0.040 | 0.250 | 0.022 | 0.0240 | 0.0110 | | 799 | Steel according to the present invention |
| 48 | 0.46 | 0.300 | 0.420 | 0.010 | 0.0004 | 0.0031 | 0.0018 | 0.039 | 0.250 | 0.021 | 0.0250 | 0.0196 | | 799 | Steel according to the present invention |

TABLE 1B-continued

| Steel | Chemical composition (mass %) Remainder Fe and Impurities | | | | | | | | | | | | | $Ac_3$ | |
|---|---|---|---|---|---|---|---|---|---|---|---|---|---|---|---|
| No. | C | Si | Mn | P | S | N | O | Al | Cr | Ti | Nb | B | Others | (° C.) | Remarks |
| 49 | 0.42 | 0.240 | 0.300 | 0.011 | 0.0005 | 0.0029 | 0.0018 | 0.034 | 0.100 | 0.022 | 0.0300 | 0.0002 | | 805 | Steel according to Comparative Example |
| 50 | 0.46 | 0.300 | 0.420 | 0.012 | 0.0005 | 0.0032 | 0.0019 | 0.040 | 0.250 | 0.021 | 0.0250 | 0.0250 | | 800 | Steel according to Comparative Example |

Underlines indicate that values are out of the scope of the present invention.

TABLE 1C

| Steel | Chemical composition (mass %) Remainder Fe and Impurities | | | | | | | | | | | | | $Ac_3$ | |
|---|---|---|---|---|---|---|---|---|---|---|---|---|---|---|---|
| No. | C | Si | Mn | P | S | N | O | Al | Cr | Ti | Nb | B | Others | (° C.) | Remarks |
| 51 | 0.46 | 0.430 | 0.415 | 0.009 | 0.0003 | 0.0035 | 0.0016 | 0.044 | 0.270 | 0.020 | 0.0180 | 0.0025 | Mo: 0.190 | 812 | Steel according to the present invention |
| 52 | 0.46 | 0.430 | 0.415 | 0.009 | 0.0004 | 0.0033 | 0.0018 | 0.043 | 0.270 | 0.020 | 0.0190 | 0.0024 | Mo: 0.970 | 837 | Steel according to the present invention |
| 53 | 0.46 | 0.430 | 0.415 | 0.010 | 0.0004 | 0.0035 | 0.0017 | 0.043 | 0.270 | 0.021 | 0.0180 | 0.0025 | Co: 0.10 | 807 | Steel according to the present invention |
| 54 | 0.46 | 0.420 | 0.415 | 0.009 | 0.0005 | 0.0034 | 0.0018 | 0.044 | 0.260 | 0.020 | 0.0190 | 0.0026 | Ni: 0.25 | 802 | Steel according to the present invention |
| 55 | 0.46 | 0.430 | 0.410 | 0.007 | 0.0004 | 0.0033 | 0.0015 | 0.040 | 0.270 | 0.021 | 0.0200 | 0.0025 | Cu: 0.40 | 805 | Steel according to the present invention |
| 56 | 0.46 | 0.430 | 0.410 | 0.008 | 0.0006 | 0.0035 | 0.0017 | 0.041 | 0.270 | 0.021 | 0.0200 | 0.0026 | V: 0.15 | 822 | Steel according to the present invention |
| 57 | 0.46 | 0.430 | 0.420 | 0.010 | 0.0005 | 0.0034 | 0.0020 | 0.042 | 0.270 | 0.021 | 0.0200 | 0.0026 | V: 0.88 | 898 | Steel according to the present invention |
| 58 | 0.46 | 0.420 | 0.410 | 0.009 | 0.0005 | 0.0033 | 0.0020 | 0.043 | 0.280 | 0.020 | 0.0180 | 0.0024 | W: 0.50 | 806 | Steel according to the present invention |
| 59 | 0.46 | 0.420 | 0.410 | 0.010 | 0.0005 | 0.0033 | 0.0018 | 0.044 | 0.280 | 0.020 | 0.0190 | 0.0025 | Ca: 0.0050 | 807 | Steel according to the present invention |
| 60 | 0.46 | 0.420 | 0.430 | 0.010 | 0.0004 | 0.0027 | 0.0021 | 0.045 | 0.290 | 0.022 | 0.0210 | 0.0026 | Mg: 0.0040 | 807 | Steel according to the present invention |
| 61 | 0.46 | 0.430 | 0.400 | 0.008 | 0.0002 | 0.0016 | 0.0023 | 0.037 | 0.280 | 0.020 | 0.0190 | 0.0024 | REM: 0.0045 | 805 | Steel according to the present invention |
| 62 | 0.46 | 0.410 | 0.410 | 0.009 | 0.0005 | 0.0030 | 0.0018 | 0.040 | 0.270 | 0.021 | 0.0220 | 0.0023 | Sb: 0.02 | 805 | Steel according to the present invention |
| 63 | 0.46 | 0.420 | 0.400 | 0.010 | 0.0003 | 0.0033 | 0.0020 | 0.035 | 0.280 | 0.022 | 0.0220 | 0.0026 | Zr: 0.09 | 807 | Steel according to the present invention |
| 64 | 0.46 | 0.430 | 0.400 | 0.011 | 0.0005 | 0.0031 | 0.0016 | 0.043 | 0.280 | 0.020 | 0.0230 | 0.0025 | As: 0.0023 | 808 | Steel according to the present invention |
| 65 | 0.46 | 0.420 | 0.420 | 0.009 | 0.0003 | 0.0026 | 0.0021 | 0.045 | 0.270 | 0.022 | 0.0240 | 0.0024 | Sn: 0.05 | 806 | Steel according to the present invention |
| 66 | 0.46 | 0.420 | 0.416 | 0.009 | 0.0005 | 0.0034 | 0.0018 | 0.045 | 0.260 | 0.020 | 0.0190 | 0.0025 | Ni: 2.80 | 763 | Steel according to the present invention |
| 67 | 0.46 | 0.420 | 0.410 | 0.010 | 0.0006 | 0.0030 | 0.0019 | 0.043 | 0.265 | 0.021 | 0.0190 | 0.0023 | Cu: 2.85 | 807 | Steel according to the present invention |

TABLE 2A

| Manufacturing No. | Steel No. | First heat treatment | | Second heat treatment | | Third heat treatment | | Fourth heat treatment | |
|---|---|---|---|---|---|---|---|---|---|
| | | Heating temperature (° C.) | Cooling stop temperature (° C.) | Heating temperature (° C.) | Cooling stop temperature (° C.) | Heating temperature (° C.) | Cooling stop temperature (° C.) | Heating temperature (° C.) | Cooling stop temperature (° C.) |
| 1 | 1 | 900 | 260 | 850 | 260 | 850 | 70 | 850 | 70 |
| 2 | 2 | 930 | 300 | 810 | 40 | | | | |
| 3 | 3 | 900 | 200 | 930 | 200 | | | | |
| 4 | 4 | 900 | 260 | 850 | 260 | 850 | 70 | 850 | 50 |
| 5 | 5 | 900 | 270 | 850 | 270 | 850 | 65 | | |
| 6 | 6 | 900 | 270 | 850 | 270 | 850 | 70 | 850 | 70 |
| 7 | 7 | 920 | 280 | 870 | 280 | 870 | 70 | 870 | 70 |
| 8 | 8 | 900 | 260 | 850 | 260 | 850 | 70 | | |
| 9 | 9 | 900 | 270 | 850 | 270 | 850 | 40 | 850 | 40 |
| 10 | 10 | 900 | 280 | 870 | 280 | 870 | 70 | 870 | 70 |
| 11 | 11 | 930 | 260 | 890 | 260 | 890 | 70 | | |
| 12 | 12 | 900 | 270 | 850 | 270 | 850 | 40 | | |
| 13 | 13 | 900 | 270 | 890 | 270 | 890 | 70 | | |
| 14 | 14 | 900 | 270 | 850 | 270 | 850 | 40 | 850 | 40 |
| 15 | 15 | 900 | 270 | 850 | 270 | 850 | 40 | 850 | 40 |
| 16 | 16 | 900 | 270 | 850 | 270 | 850 | 40 | 850 | 40 |
| 17 | 17 | 900 | 270 | 850 | 270 | 850 | 100 | | |
| 18 | 18 | 900 | 270 | 850 | 270 | 850 | 40 | | |
| 19 | 19 | 920 | 260 | 890 | 260 | 890 | 50 | | |
| 20 | 20 | 920 | 260 | 890 | 260 | 890 | 50 | | |
| 21 | 21 | 900 | 270 | 850 | 270 | 850 | 40 | 850 | 40 |
| 22 | 22 | 900 | 270 | 850 | 270 | 850 | 40 | | |
| 23 | 23 | 900 | 270 | 850 | 270 | 850 | 40 | | |
| 24 | 24 | 900 | 270 | 850 | 270 | 850 | 40 | | |
| 25 | 25 | 900 | 270 | 850 | 270 | 850 | 40 | 850 | 40 |

| Manufacturing No. | Fifth heat treatment | | Sixth heat treatment | | Remarks |
|---|---|---|---|---|---|
| | Heating temperature (° C.) | Cooling stop temperature (° C.) | Heating temperature (° C.) | Cooling stop temperature (° C.) | |
| 1 | | | | | Example of the present invention |
| 2 | | | | | Comparative Example |
| 3 | | | | | Comparative Example |
| 4 | | | | | Example of the present invention |
| 5 | | | | | Example of the present invention |
| 6 | 850 | 70 | 850 | 70 | Example of the present invention |
| 7 | | | | | Comparative Example |
| 8 | | | | | Comparative Example |
| 9 | | | | | Example of the present invention |
| 10 | 870 | 70 | | | Example of the present invention |
| 11 | | | | | Example of the present invention |
| 12 | | | | | Comparative Example |
| 13 | | | | | Comparative Example |
| 14 | 850 | 40 | 850 | 40 | Example of the present invention |
| 15 | 850 | 40 | | | Example of the present invention |
| 16 | 850 | 40 | | | Example of the present invention |
| 17 | | | | | Comparative Example |
| 18 | | | | | Comparative Example |
| 19 | | | | | Example of the present invention |
| 20 | | | | | Comparative Example |
| 21 | | | | | Example of the present invention |

TABLE 2A-continued

| | |
|---|---|
| 22 | Comparative Example |
| 23 | Example of the present invention |
| 24 | Comparative Example |
| 25 | Example of the present invention |

Underlines indicate that manufacturing conditions are not preferable.

TABLE 2B

| | | First heat treatment | | Second heat treatment | | Third heat treatment | | Fourth heat treatment | |
|---|---|---|---|---|---|---|---|---|---|
| Manufacturing No. | Steel No. | Heating temperature (° C.) | Cooling stop temperature (° C.) | Heating temperature (° C.) | Cooling stop temperature (° C.) | Heating temperature (° C.) | Cooling stop temperature (° C.) | Heating temperature (° C.) | Cooling stop temperature (° C.) |
| 26 | 26 | 900 | 270 | 850 | 270 | 850 | 40 | | |
| 27 | 27 | 900 | 260 | 850 | 260 | 850 | 40 | 850 | 40 |
| 28 | 28 | 920 | 270 | 880 | 270 | 880 | 50 | 880 | 50 |
| 29 | 29 | 920 | 270 | 880 | 270 | 880 | 50 | 880 | 50 |
| 30 | 30 | 900 | 260 | 850 | 260 | 850 | 40 | | |
| 31 | 31 | 920 | 270 | 880 | 270 | 880 | 50 | 880 | 50 |
| 32 | 32 | 900 | 270 | 850 | 270 | 850 | 40 | 850 | 40 |
| 33 | 33 | 900 | 270 | 850 | 270 | 850 | 40 | 850 | 40 |
| 34 | 34 | 900 | 270 | 850 | 270 | 850 | 40 | 850 | 40 |
| 35 | 35 | 900 | 270 | 850 | 270 | 850 | 40 | | |
| 36 | 36 | 900 | 270 | 850 | 270 | 850 | 40 | | |
| 37 | 37 | 900 | 270 | 850 | 270 | 850 | 40 | 850 | 40 |
| 38 | 38 | 900 | 270 | 850 | 270 | 850 | 40 | 850 | 40 |
| 39 | 39 | 900 | 270 | 870 | 270 | 870 | 40 | 870 | 40 |
| 40 | 40 | 900 | 260 | 870 | 270 | 870 | 40 | | |
| 41 | 41 | 900 | 270 | 870 | 270 | 870 | 40 | | |
| 42 | 42 | 900 | 270 | 850 | 270 | 850 | 40 | 850 | 40 |
| 43 | 43 | 900 | 270 | 870 | 270 | 870 | 40 | | |
| 44 | 44 | 900 | 260 | 870 | 270 | 870 | 40 | | |
| 45 | 45 | 900 | 260 | 870 | 270 | 870 | 40 | | |
| 46 | 46 | 900 | 270 | 850 | 270 | 850 | 40 | 850 | 40 |
| 47 | 47 | 900 | 270 | 850 | 270 | 850 | 40 | 850 | 40 |
| 48 | 48 | 900 | 270 | 850 | 270 | 850 | 40 | 850 | 40 |
| 49 | 49 | 900 | 260 | 870 | 270 | 870 | 40 | 870 | 40 |
| 50 | 50 | 900 | 270 | 850 | 270 | 850 | 40 | 850 | 40 |

| | Fifth heat treatment | | Sixth heat treatment | | |
|---|---|---|---|---|---|
| Manufacturing No. | Heating temperature (° C.) | Cooling stop temperature (° C.) | Heating temperature (° C.) | Cooling stop temperature (° C.) | Remarks |
| 26 | | | | | Comparative Example |
| 27 | 850 | 40 | | | Example of the present invention |
| 28 | | | | | Example of the present invention |
| 29 | | | | | Example of the present invention |
| 30 | | | | | Comparative Example |
| 31 | | | | | Comparative Example |
| 32 | | | | | Example of the present invention |
| 33 | 850 | 40 | 850 | 40 | Example of the present invention |
| 34 | 850 | 40 | 850 | 40 | Example of the present invention |
| 35 | | | | | Comparative Example |
| 36 | | | | | Comparative Example |
| 37 | | | | | Example of the present invention |
| 38 | 850 | 40 | | | Example of the present invention |
| 39 | | | | | Example of the present invention |
| 40 | | | | | Comparative Example |
| 41 | | | | | Comparative Example |

TABLE 2B-continued

| | | | | | |
|---|---|---|---|---|---|
| 42 | 850 | 40 | 850 | 40 | Example of the present invention |
| 43 | | | | | Example of the present invention |
| 44 | | | | | Comparative Example |
| 45 | | | | | Comparative Example |
| 46 | | | | | Eixample of the present invention |
| 47 | | | | | Eixample of the present invention |
| 48 | | | | | Example of the present invention |
| 49 | 870 | 40 | 870 | 40 | Comparative Example |
| 50 | | | | | Comparative Example |

Underlines indicate that manufacturing conditions are not preferable.

TABLE 2C

| | | First heat treatment | | Second heat treatment | | Third heat treatment | | Fourth heat treatment | |
|---|---|---|---|---|---|---|---|---|---|
| Manufacturing No. | Steel No. | Heating temperature (° C.) | Cooling stop temperature (° C.) | Heating temperature (° C.) | Cooling stop temperature (° C.) | Heating temperature (° C.) | Cooling stop temperature (° C.) | Heating temperature (° C.) | Cooling stop temperature (° C.) |
| 51 | 51 | 900 | 270 | 850 | 270 | 850 | 40 | 850 | 40 |
| 52 | 52 | 900 | 270 | 850 | 270 | 850 | 40 | 850 | 40 |
| 53 | 53 | 900 | 270 | 850 | 270 | 850 | 40 | 850 | 40 |
| 54 | 54 | 900 | 270 | 850 | 270 | 850 | 40 | | |
| 55 | 55 | 900 | 270 | 850 | 270 | 850 | 40 | | |
| 56 | 56 | 1000 | 270 | 850 | 270 | 850 | 40 | | |
| 57 | 57 | 950 | 270 | 930 | 270 | 930 | 40 | | |
| 58 | 58 | 900 | 270 | 850 | 270 | 850 | 40 | 850 | 40 |
| 59 | 59 | 900 | 270 | 850 | 270 | 850 | 40 | 850 | 40 |
| 60 | 60 | 900 | 270 | 850 | 270 | 850 | 40 | 850 | 40 |
| 61 | 61 | 900 | 260 | 850 | 260 | 850 | 50 | 850 | 50 |
| 62 | 62 | 900 | 270 | 850 | 270 | 850 | 40 | 850 | 40 |
| 63 | 63 | 900 | 270 | 850 | 270 | 850 | 40 | | |
| 64 | 64 | 870 | 270 | 850 | 270 | 850 | 40 | 850 | 40 |
| 65 | 65 | 900 | 270 | 850 | 270 | 850 | 40 | 850 | 40 |
| 66 | 51 | 900 | 27 | | | | | | |
| 67 | 51 | 900 | 270 | 850 | 27 | | | | |
| 68 | 51 | 1000 | 270 | 850 | 270 | 850 | 40 | | |
| 69 | 51 | 820 | 270 | 850 | 270 | 850 | 40 | | |
| 70 | 51 | 1100 | 270 | 850 | 270 | 850 | 40 | | |
| 71 | 51 | 800 | 270 | 850 | 270 | 850 | 40 | | |
| 72 | 51 | 900 | 350 | 850 | 270 | 850 | 40 | | |
| 73 | 51 | 900 | 250 | 850 | 270 | 850 | 40 | | |
| 74 | 51 | 900 | 370 | 850 | 270 | 850 | 40 | | |
| 75 | 51 | 900 | 230 | 850 | 270 | 850 | 40 | | |

| | Fifth heat treatment | | Sixth heat treatment | | |
|---|---|---|---|---|---|
| Manufacturing No. | Heating temperature (° C.) | Cooling stop temperature (° C.) | Heating temperature (° C.) | Cooling stop temperature (° C.) | Remarks |
| 51 | | | | | Example of the present invention |
| 52 | | | | | Example of the present invention |
| 53 | 850 | 40 | | | Example of the present invention |
| 54 | | | | | Example of the present invention |
| 55 | | | | | Example of the present invention |
| 56 | | | | | Example of the present invention |
| 57 | | | | | Example of the present invention |
| 58 | | | | | Example of the present invention |

TABLE 2C-continued

| | | | | | | |
|---|---|---|---|---|---|---|
| 59 | | | | | | Example of the present invention |
| 60 | | | | | | Example of the present invention |
| 61 | | | | | | Example of the present invention |
| 62 | 850 | 40 | 850 | 40 | | Example of the present invention |
| 63 | | | | | | Example of the present invention |
| 64 | | | | | | Example of the present invention |
| 65 | 850 | 40 | 850 | 40 | | Example of the present invention |
| 66 | | | | | | Comparative Example |
| 67 | | | | | | Comparative Example |
| 68 | | | | | | Example of the present invention |
| 69 | | | | | | Example of the present invention |
| 70 | | | | | | Comparative Example |
| 71 | | | | | | Comparative Example |
| 72 | | | | | | Example of the present invention |
| 73 | | | | | | Example of the present invention |
| 74 | | | | | | Comparative Example |
| 75 | | | | | | Comparative Example |

Underlines indicate that manufacturing conditions are not preferable.

TABLE 2D

| | | First heat treatment | | Second heat treatment | | Third heat treatment | | Fourth heat treatment | |
|---|---|---|---|---|---|---|---|---|---|
| Manufacturing No. | Steel No. | Heating temperature (° C.) | Cooling stop temperature (° C.) | Heating temperature (° C.) | Cooling stop temperature (° C.) | Heating temperature (° C.) | Cooling stop temperature (° C.) | Heating temperature (° C.) | Cooling stop temperature (° C.) |
| 76 | 51 | 900 | 270 | 1000 | 270 | 850 | 40 | | |
| 77 | 51 | 900 | 270 | 820 | 270 | 850 | 40 | | |
| 78 | 51 | 900 | 270 | 1150 | 270 | 850 | 40 | | |
| 79 | 51 | 900 | 270 | 800 | 270 | 850 | 40 | | |
| 80 | 51 | 900 | 270 | 850 | 350 | 850 | 40 | | |
| 81 | 51 | 900 | 270 | 850 | 250 | 850 | 40 | | |
| 82 | 51 | 900 | 270 | 850 | 370 | 850 | 40 | | |
| 83 | 51 | 900 | 270 | 850 | 230 | 850 | 40 | | |
| 84 | 51 | 900 | 270 | 850 | 270 | 1000 | 40 | | |
| 85 | 51 | 900 | 270 | 850 | 270 | 820 | 40 | | |
| 86 | 51 | 900 | 270 | 850 | 270 | 1150 | 40 | | |
| 87 | 51 | 900 | 270 | 850 | 270 | 780 | 40 | | |
| 88 | 51 | 900 | 270 | 850 | 270 | 850 | 240 | | |
| 89 | 51 | 900 | 270 | 850 | 270 | 850 | 400 | | |
| 90 | 66 | 900 | 270 | 850 | 270 | 840 | 40 | | |
| 91 | 67 | 900 | 270 | 850 | 270 | 850 | 40 | | |
| 92 | 1 | 950 | 290 | 820 | 40 | | | | |
| 93 | 42 | 950 | 280 | 820 | 30 | | | | |
| 94 | 60 | 990 | 300 | 840 | 40 | | | | |
| 95 | 56 | 950 | 290 | 810 | 40 | | | | |
| 96 | 51 | 900 | 250 | 850 | 250 | 850 | 40 | | |

TABLE 2D-continued

| Manufacturing No. | Fifth heat treatment Heating temperature (° C.) | Fifth heat treatment Cooling stop temperature (° C.) | Sixth heat treatment Heating temperature (° C.) | Sixth heat treatment Cooling stop temperature (° C.) | Remarks |
|---|---|---|---|---|---|
| 76 | | | | | Example of the present invention |
| 77 | | | | | Example of the present invention |
| 78 | | | | | Comparative Example |
| 79 | | | | | Comparative Example |
| 80 | | | | | Example of the present invention |
| 81 | | | | | Example of the present invention |
| 82 | | | | | Comparative Example |
| 83 | | | | | Comparative Example |
| 84 | | | | | Example of the present invention |
| 85 | | | | | Example of the present invention |
| 86 | | | | | Comparative Example |
| 87 | | | | | Comparative Example |
| 88 | | | | | Example of the present invention |
| 89 | | | | | Comparative Example |
| 90 | | | | | Example of the present invention |
| 91 | | | | | Example of the present invention |
| 92 | | | | | Comparative Example |
| 93 | | | | | Comparative Example |
| 94 | | | | | Comparative Example |
| 95 | | | | | Comparative Example |
| 96 | | | | | Comparative Example |

Underlines indicate that manufacturing conditions are not preferable.

TABLE 3A

| Manufacturing No. | Steel No. | Hot-stamp formed body: Plating | Tempering | Partially softened region | Martensite (area %) | Percentage of martensite having GATQ value of 40000 or less (%) | Average grain size of prior γ grains (μm) | Standard deviation of grain sizes of prior γ grains (μm) | Tensile strength (MPa) | Hydrogen embrittlement resistance | Remarks |
|---|---|---|---|---|---|---|---|---|---|---|---|
| 1 | 1 | Absent | Absent | Absent | 99 | 1.1 | 5.2 | 2.1 | 2513 | Very good | Example of the present invention |
| 2 | 2 | Absent | Absent | Absent | 100 | 2.5 | 3.9 | 4.9 | 2340 | Bad | Comparative Example |
| 3 | 3 | Absent | Absent | Absent | 100 | 3.0 | 13.6 | 5.2 | 2297 | Bad | Comparative Example |
| 4 | 4 | Present | Absent | Absent | 98 | 1.2 | 5.7 | 2.2 | 2315 | Very good | Example of the present invention |
| 5 | 5 | Absent | Absent | Absent | 100 | 1.8 | 4.3 | 2.5 | 2782 | Good | Example of the present invention |
| 6 | 6 | Absent | Present | Present | 100 | 3.9 | 3.1 | 2.4 | 3028 | Fair | Example of the present invention |
| 7 | 7 | Present | Absent | Absent | 96 | 0.9 | 5.6 | 2.3 | 2275 | Good | Comparative Example |

TABLE 3A-continued

| Manufacturing No. | Steel No. | Hot-stamp formed body: Plating | Tempering | Partially softened region | Martensite (area %) | Percentage of martensite having GATQ value of 40000 or less (%) | Average grain size of prior γ grains (μm) | Standard deviation of grain sizes of prior γ grains (μm) | Tensile strength (MPa) | Hydrogen embrittlement resistance | Remarks |
|---|---|---|---|---|---|---|---|---|---|---|---|
| 8 | 8 | Absent | Absent | Absent | 100 | 3.8 | 3.4 | 2.5 | 2589 | Bad | Comparative Example |
| 9 | 9 | Present | Absent | Absent | 99 | 1.5 | 4.5 | 2.1 | 2487 | Very good | Example of the present invention |
| 10 | 10 | Absent | Absent | Absent | 98 | 1.0 | 4.0 | 2.1 | 2534 | Very good | Example of the present invention |
| 11 | 11 | Absent | Present | Present | 95 | 2.0 | 5.4 | 2.2 | 2497 | Good | Example of the present invention |
| 12 | 12 | Present | Absent | Absent | 97 | 3.7 | 5.8 | 2.3 | 2288 | Good | Comparative Example |
| 13 | 13 | Absent | Present | Present | 88 | 4.1 | 5.7 | 3.0 | 2254 | Bad | Comparative Example |
| 14 | 14 | Absent | Absent | Absent | 90 | 1.0 | 5.2 | 2.0 | 2416 | Very good | Example of the present invention |
| 15 | 15 | Absent | Absent | Absent | 100 | 4.2 | 4.2 | 2.2 | 2511 | Good | Example of the present invention |
| 16 | 16 | Absent | Present | Present | 100 | 4.6 | 4.3 | 2.4 | 2523 | Fair | Example of the present invention |
| 17 | 17 | Absent | Absent | Absent | 82 | 0.8 | 5.8 | 2.5 | 2133 | Very good | Comparative Example |
| 18 | 18 | Absent | Absent | Absent | 100 | 7.0 | 4.8 | 2.0 | 2645 | Bad | Comparative Example |
| 19 | 19 | Absent | Absent | Absent | 99 | 1.7 | 4.7 | 2.3 | 2496 | Fair | Example of the present invention |
| 20 | 20 | Absent | Absent | Absent | 98 | 1.3 | 5.1 | 2.2 | 2211 | Bad | Comparative Example |
| 21 | 21 | Present | Absent | Absent | 98 | 1.5 | 4.6 | 2.3 | 2472 | Good | Example of the present invention |
| 22 | 22 | Absent | Absent | Absent | 97 | 1.4 | 4.9 | 2.5 | 2428 | Bad | Comparative Example |
| 23 | 23 | Absent | Absent | Absent | 99 | 1.5 | 4.7 | 2.5 | 2449 | Fair | Example of the present invention |
| 24 | 24 | Absent | Absent | Absent | 100 | 1.4 | 4.6 | 2.4 | 2440 | Bad | Comparative Example |
| 25 | 25 | Absent | Absent | Absent | 100 | 1.4 | 4.5 | 2.4 | 2452 | Fair | Example of the present invention |

Underlines indicate that values are out of the scope of the present invention and that properties are not preferable.

TABLE 3B

| Manufacturing No. | Steel No. | Hot-stamp formed body: Plating | Tempering | Partially softened region | Martensite (area %) | Percentage of martensite having GAIQ value of 40000 or less (%) | Average grain size of prior γ grains (μm) | Standard deviation of grain sizes of prior γ grains (μm) | Tensile strength (MPa) | Hydrogen embrittlement resistance | Remarks |
|---|---|---|---|---|---|---|---|---|---|---|---|
| 26 | 26 | Absent | Absent | Absent | 99 | 1.5 | 4.8 | 2.5 | 2221 | Bad | Comparative Example |
| 27 | 27 | Present | Absent | Absent | 100 | 1.3 | 4.4 | 2.2 | 2467 | Good | Example of the present invention |
| 28 | 28 | Absent | Absent | Absent | 100 | 1.4 | 4.8 | 2.3 | 2453 | Good | Example of the present invention |
| 29 | 29 | Absent | Absent | Absent | 97 | 1.2 | 4.9 | 2.3 | 2435 | Good | Example of the present invention |
| 30 | 30 | Present | Absent | Absent | 100 | 1.3 | 4.7 | 2.2 | 2215 | Bad | Comparative Example |
| 31 | 31 | Absent | Absent | Absent | 96 | 1.4 | 5.2 | 2.5 | 2411 | Bad | Comparative Example |
| 32 | 32 | Present | Absent | Absent | 99 | 3.4 | 4.8 | 2.3 | 2483 | Good | Example of the present invention |

TABLE 3B-continued

| Manufacturing No. | Steel No. | Hot-stamp formed body | | | | | | | | | |
|---|---|---|---|---|---|---|---|---|---|---|---|
| | | Plating | Tempering | Partially softened region | Martensite (area %) | Percentage of martensite having GAIQ value of 40000 or less (%) | Average grain size of prior γ grains (μm) | Standard deviation of grain sizes of prior γ grains (μm) | Tensile strength (MPa) | Hydrogen embrittlement resistance | Remarks |
| 33 | 33 | Absent | Absent | Absent | 100 | 1.2 | 4.3 | 1.9 | 2534 | Very good | Example of the present invention |
| 34 | 34 | Absent | Present | Present | 100 | 1.3 | 4.2 | 1.8 | 2556 | Very good | Example of the present invention |
| 35 | 35 | Absent | Absent | Absent | 92 | 2.2 | 5.5 | 2.3 | 2215 | Good | Comparative Example |
| 36 | 36 | Absent | Absent | Absent | 100 | 5.2 | 4.7 | 2.5 | 2572 | Bad | Comparative Example |
| 37 | 37 | Absent | Absent | Absent | 100 | 1.6 | 5.3 | 2.3 | 2413 | Good | Example of the present invention |
| 38 | 38 | Absent | Absent | Absent | 100 | 1.2 | 4.5 | 2.1 | 2477 | Very good | Example of the present invention |
| 39 | 39 | Absent | Absent | Absent | 100 | 1.4 | 4.8 | 2.3 | 2466 | Good | Example of the present invention |
| 40 | 40 | Absent | Absent | Absent | 100 | 2.4 | 6.2 | 4.8 | 2285 | Bad | Comparative Example |
| 41 | 41 | Absent | Absent | Absent | 100 | 1.6 | 4.6 | 2.4 | 2482 | Bad | Comparative Example |
| 42 | 42 | Absent | Absent | Absent | 100 | 1.4 | 5.6 | 2.3 | 2498 | Good | Example of the present invention |
| 43 | 43 | Absent | Absent | Absent | 100 | 1.7 | 4.1 | 2.3 | 2533 | Good | Example of the present invention |
| 44 | 44 | Absent | Present | Present | 100 | 2.3 | 6.6 | 5.1 | 2218 | Bad | Comparative Example |
| 45 | 45 | Absent | Absent | Absent | 99 | 1.6 | 5.1 | 2.4 | 2486 | Bad | Comparative Example |
| 46 | 46 | Absent | Absent | Absent | 99 | 3.1 | 4.7 | 2.3 | 2485 | Good | Example of the present invention |
| 47 | 47 | Present | Present | Present | 100 | 1.4 | 5.0 | 2.2 | 2427 | Good | Example of the present invention |
| 48 | 48 | Absent | Absent | Absent | 100 | 1.4 | 4.8 | 2.4 | 2469 | Fair | Example of the present invention |
| 49 | 49 | Present | Present | Absent | 86 | 1.2 | 4.5 | 2.1 | 2179 | Very good | Comparative Example |
| 50 | 50 | Absent | Absent | Absent | 100 | 1.3 | 4.7 | 2.5 | 2480 | Bad | Comparative Example |

Underlines indicate that values are out of the scope of the present invention and that properties are not preferable.

TABLE 3C

| Manufacturing No. | Steel No. | Hot-stamp formed body | | | | | | | | | |
|---|---|---|---|---|---|---|---|---|---|---|---|
| | | Plating | Tempering | Partially softened region | Martensite (area %) | Percentage of martensite having GAIQ value of 40000 or less (%) | Average grain size of prior γ grains (μm) | Standard deviation of grain sizes of prior γ grains (μm) | Tensile strength (MPa) | Hydrogen embrittlement resistance | Remarks |
| 51 | 51 | Absent | Absent | Absent | 100 | 1.2 | 5.4 | 2.3 | 2515 | Good | Example of the present invention |
| 52 | 52 | Absent | Present | Absent | 100 | 0.7 | 5.3 | 2.2 | 2370 | Very good | Example of the present invention |
| 53 | 53 | Absent | Absent | Absent | 98 | 0.2 | 5.2 | 2.1 | 2479 | Very good | Example of the present invention |
| 54 | 54 | Present | Absent | Absent | 100 | 1.4 | 5.4 | 2.3 | 2510 | Very good | Example of the present invention |
| 55 | 55 | Present | Absent | Absent | 100 | 1.3 | 5.5 | 2.3 | 2504 | Good | Example of the present invention |
| 56 | 56 | Absent | Absent | Absent | 100 | 1.5 | 5.8 | 2.5 | 2485 | Fair | Example of the present invention |
| 57 | 57 | Absent | Absent | Absent | 100 | 1.3 | 5.5 | 2.5 | 2461 | Fair | Example of the present invention |

TABLE 3C-continued

| Manufacturing No. | Steel No. | Hot-stamp formed body | | | | | | | | | Remarks |
|---|---|---|---|---|---|---|---|---|---|---|---|
| | | Plating | Tempering | Partially softened region | Martensite (area %) | Percentage of martensite having GAIQ value of 40000 or less (%) | Average grain size of prior γ grains (μm) | Standard deviation of grain sizes of prior γ grains (μm) | Tensile strength (MPa) | Hydrogen embrittlement resistance | |
| 58 | 58 | Absent | Absent | Absent | 100 | 0.9 | 5.3 | 2.2 | 2504 | Very good | Example of the present invention |
| 59 | 59 | Absent | Absent | Absent | 100 | 1.3 | 5.4 | 2.2 | 2501 | Good | Example of the present invention |
| 60 | 60 | Absent | Absent | Absent | 100 | 1.3 | 5.3 | 2.2 | 2498 | Good | Example of the present invention |
| 61 | 61 | Absent | Absent | Absent | 100 | 1.5 | 5.4 | 2.3 | 2487 | Good | Example of the present invention |
| 62 | 62 | Present | Absent | Absent | 99 | 0.9 | 5.1 | 2.1 | 2506 | Very good | Example of the present invention |
| 63 | 63 | Absent | Absent | Absent | 100 | 0.9 | 5.3 | 2.2 | 2487 | Very good | Example of the present invention |
| 64 | 64 | Absent | Absent | Absent | 100 | 0.8 | 4.8 | 2.3 | 2499 | Good | Example of the present invention |
| 65 | 65 | Present | Absent | Absent | 100 | 0.5 | 4.6 | 2.1 | 2521 | Very good | Example of the present invention |
| 66 | 51 | Absent | Absent | Absent | 100 | 1.0 | 6.9 | 3.2 | 2480 | Bad | Comparative Example |
| 67 | 51 | Absent | Absent | Absent | 100 | 0.9 | 6.1 | 2.8 | 2490 | Bad | Comparative Example |
| 68 | 51 | Absent | Absent | Absent | 100 | 1.3 | 5.7 | 2.4 | 2499 | Fair | Example of the present invention |
| 69 | 51 | Absent | Absent | Absent | 99 | 0.9 | 5.2 | 2.2 | 2534 | Good | Example of the present invention |
| 70 | 51 | Absent | Absent | Absent | 100 | 1.1 | 6.5 | 2.8 | 2423 | Bad | Comparative Example |
| 71 | 51 | Absent | Absent | Absent | 98 | 1.7 | 5.3 | 4.5 | 2466 | Bad | Comparative Example |
| 72 | 51 | Absent | Absent | Absent | 94 | 1.0 | 5.6 | 2.3 | 2325 | Good | Example of the present invention |
| 73 | 51 | Absent | Absent | Absent | 100 | 2.0 | 5.5 | 2.6 | 2503 | Fair | Example of the present invention |
| 74 | 51 | Absent | Absent | Absent | 89 | 1.2 | 8.0 | 3.5 | 2295 | Bad | Comparative Example |
| 75 | 51 | Absent | Absent | Absent | 100 | 2.1 | 6.3 | 3.9 | 2450 | Bad | Comparative Example |

Underlines indicate that values are out of the scope of the present invention and that properties are not preferable.

TABLE 3D

| Manufacturing No. | Steel No. | Hot-stamp formed body | | | | | | | | | Remarks |
|---|---|---|---|---|---|---|---|---|---|---|---|
| | | Plating | Tempering | Partially softened region | Martensite (area %) | Percentage of martensite having GAIQ value of 40000 or less (%) | Average grain size of prior γ grains (μm) | Standard deviation of grain sizes of prior γ grains (μm) | Tensile strength (MPa) | Hydrogen embrittlement resistance | |
| 76 | 51 | Absent | Absent | Absent | 100 | 1.2 | 5.8 | 2.4 | 2489 | Fair | Example of the present invention |
| 77 | 51 | Absent | Absent | Absent | 100 | 0.9 | 5.1 | 2.2 | 2543 | Good | Example of the present invention |
| 78 | 51 | Absent | Absent | Absent | 100 | 1.3 | 6.2 | 3.0 | 2446 | Bad | Comparative Example |
| 79 | 51 | Absent | Absent | Absent | 100 | 1.9 | 5.3 | 4.7 | 2457 | Bad | Comparative Example |
| 80 | 51 | Absent | Absent | Absent | 96 | 1.2 | 5.5 | 2.4 | 2333 | Good | Example of the present invention |
| 81 | 51 | Absent | Absent | Absent | 100 | 1.8 | 5.7 | 2.5 | 2489 | Fair | Example of the present invention |

TABLE 3D-continued

| Manufacturing No. | Steel No. | Hot-stamp formed body: Plating | Tempering | Partially softened region | Martensite (area %) | Percentage of martensite having GAIQ value of 40000 or less (%) | Average grain size of prior γ grains (μm) | Standard deviation of grain sizes of prior γ grains (μm) | Tensile strength (MPa) | Hydrogen embrittlement resistance | Remarks |
|---|---|---|---|---|---|---|---|---|---|---|---|
| 82 | 51 | Absent | Absent | Absent | 88 | 1.3 | 8.3 | 3.5 | 2280 | Bad | Comparative Example |
| 83 | 51 | Absent | Absent | Absent | 100 | 2.2 | 6.5 | 4.0 | 2420 | Bad | Comparative Example |
| 84 | 51 | Absent | Absent | Absent | 100 | 0.9 | 6.0 | 2.5 | 2485 | Fair | Example of the present invention |
| 85 | 51 | Absent | Absent | Absent | 99 | 1.1 | 4.8 | 2.1 | 2555 | Very good | Example of the present invention |
| 86 | 51 | Absent | Absent | Absent | 100 | 2.0 | 23.0 | 11.0 | 2401 | Bad | Comparative Example |
| 87 | 51 | Absent | Absent | Absent | 86 | 0.8 | 4.3 | 2.8 | 2274 | Bad | Comparative Example |
| 88 | 51 | Absent | Absent | Absent | 100 | 0.6 | 5.5 | 2.3 | 2305 | Very good | Example of the present invention |
| 89 | 51 | Absent | Absent | Absent | 85 | 0.2 | 5.6 | 2.3 | 2067 | Very good | Comparative Example |
| 90 | 66 | Present | Absent | Absent | 100 | 1.5 | 5.1 | 2.2 | 2533 | Very good | Example of the present invention |
| 91 | 67 | Present | Absent | Absent | 100 | 1.4 | 5.4 | 2.3 | 2512 | Very good | Example of the present invention |
| 92 | 1 | Absent | Absent | Absent | 99 | 1.5 | 5.0 | 3.2 | 2510 | Bad | Comparative Example |
| 93 | 42 | Absent | Absent | Absent | 100 | 1.6 | 4.3 | 2.9 | 2505 | Bad | Comparative Example |
| 94 | 60 | Absent | Present | Absent | 100 | 1.5 | 3.3 | 2.7 | 2390 | Bad | Comparative Example |
| 95 | 56 | Absent | Present | Absent | 100 | 1.6 | 3.8 | 2.8 | 2350 | Bad | Comparative Example |
| 96 | 51 | Absent | Absent | Absent | 100 | 2.5 | 5.8 | 2.7 | 2434 | Bad | Comparative Example |

Underlines indicate that values are out of the scope of the present invention and that properties are not preferable.

As can be seen from Tables 3A to 3D), the hot-stamping formed bodies according to examples of the present invention have high strength and high hydrogen embrittlement resistance.

On the other hand, it is found that the hot-stamping formed bodies according to Comparative Examples are poor in one or more properties.

INDUSTRIAL APPLICABILITY

According to the above-described aspect of the present invention, it is possible to provide a hot-stamp formed body having high strength and high hydrogen embrittlement resistance.

What is claimed is:

1. A hot-stamp formed body comprising, as a chemical composition, by mass %:

C: 0.42% to 0.70%;
Si: 0.010% to 1.300%;
Mn: 0.100 to 3.000%;
P: 0.100% or less;
S: 0.0100% or less;
N: 0.0200% or less;
O: 0.0200% or less;
Al: 0.001% to 0.500%;
Cr: 0.010% to 0.800%;
Ti: 0.010% to 0.100%;
Nb: 0.0010% to 0.1000%;
B: 0.0005% to 0.0200%;
Mo: 0% to 1.000%;
Co: 0% to 4.00%;
Ni: 0% to 3.00%;
Cu: 0% to 3.00%;
V: 0% to 1.00%;
W: 0% to 1.00%;
Ca: 0% to 1.0000%;
Mg: 0% to 1.0000%;
REM: 0% to 1.0000%;
Sb: 0% to 1.00%;
Zr: 0% to 1.00%;
Sn: 0% to 1.00%;
As: 0% to 1.0000%; and
a remainder: Fe and impurities, wherein the hot-stamp formed body has a microstructure including, by area ratio, martensite: 90% to 100% and a remainder in the microstructure: 0% to 10%, a percentage of martensite having a GAIQ value of 40000 or less in all of the martensite is less than 5.0%, an average grain size of prior austenite grains is 6.0 μm or less, and a standard deviation of grain sizes of the prior austenite grains is 2.6 μm or less.

2. The hot-stamp formed body according to claim 1, wherein the chemical composition contains, by mass %, one or more of:

Mo: 0.001% to 1.000%;
Co: 0.01% to 4.00%;
Ni: 0.01% to 3.00%;
Cu: 0.01% to 3.00%;
V: 0.01% to 1.00%;

W: 0.01% to 1.00%;
Ca: 0.0001% to 1.0000%;
Mg: 0.0001% to 1.0000%;
REM: 0.0001% to 1.0000%;
Sb: 0.001% to 1.00%;
Zr: 0.001% to 1.00%;
Sn: 0.001% to 1.00%; and
As: 0.0001% to 1.0000%.

3. The hot-stamp formed body according to claim 2, wherein the average grain size of the prior austenite grains is more than 3.0 μm.

4. The hot-stamp formed body according to claim 1, wherein the average grain size of the prior austenite grains is more than 3.0 μm.

* * * * *